US005862447A

United States Patent [19]

Matsumura

[11] Patent Number: 5,862,447

[45] Date of Patent: Jan. 19, 1999

[54] IMAGE FORMING APPARATUS, AND PAPER FEED MEMBERS THEREOF

[75] Inventor: Takuo Matsumura, Ebina, Japan

[73] Assignee: Fuji Xerox Co., Ltd., Tokyo, Japan

[21] Appl. No.: 838,703

[22] Filed: Apr. 9, 1997

[30] Foreign Application Priority Data

Apr. 11, 1996 [JP] Japan ..... 8-089810
Mar. 12, 1997 [JP] Japan ..... 9-058172

[51] Int. Cl.[6] ..... G03G 15/00

[52] U.S. Cl. ..... 399/388; 492/18; 492/28; 492/53; 492/56

[58] Field of Search ..... 399/297, 312, 399/313, 381, 388, 393, 18; 492/28, 48, 49, 53, 56, 57; 271/109, 272, 314

[56] References Cited

U.S. PATENT DOCUMENTS

| | | | |
|---|---|---|---|
| 4,053,702 | 10/1977 | Erickson et al. . | |
| 4,412,029 | 10/1983 | Kehr et al. . | |
| 5,669,605 | 9/1997 | Sawa et al. | 271/314 |
| 5,733,235 | 3/1998 | Waku et al. . | |

FOREIGN PATENT DOCUMENTS

| | | |
|---|---|---|
| 0191590 | 8/1986 | European Pat. Off. . |
| A2-0 676 676 | 10/1995 | European Pat. Off. . |
| A1-0 699 969 | 3/1996 | European Pat. Off. . |
| A1-195 42 612 | 5/1996 | Germany . |
| A1-195 43 555 | 5/1996 | Germany . |
| 8-303449 | 11/1996 | Japan . |
| 1296248 | 11/1972 | United Kingdom . |
| 1309099 | 3/1973 | United Kingdom . |
| 1392519 | 4/1975 | United Kingdom . |
| 1422809 | 1/1976 | United Kingdom . |
| 2025441 | 1/1980 | United Kingdom . |

*Primary Examiner*—William J. Royer
*Attorney, Agent, or Firm*—Oliff & Berridge, PLC

[57] ABSTRACT

A digital copier is designed to minimize image imperfections by limiting pickup of contaminants by an image carrier. Paper sheets are conveyed to an image transfer area by use of a conveyor unit. The conveyor unit includes paper feed rollers. The image transfer area includes the image carrier and a transfer roller. The paper sheets pass between the image carrier and the transfer roller. When no paper sheets are in the image transfer area, the transfer roller is in contact with the image carrier. The transfer rollers and the paper feed rollers include a rubber material with a solubility parameter chosen to minimize transfer of contaminants to the image carrier. In one example, the transfer roller and the paper feed roller are formed from a rubber material having a solubility parameter greater than or equal to 8.2 $(cal/cm^3)^{1/2}$. To further minimize imperfections in the image due to pickup of contaminants, the rubber material of the paper feed member has a dielectric constant greater than or equal to 4.5 and has a substituent other than hydrocarbon radicals attached to the principal polymer chain. Finally, the peripheral speed of the image carrier is designed to equal the speed of the paper sheet, while the speed of the transfer roller exceeds the speed of the paper sheet. As a result, contaminants are transferred to the transfer roller and not to the image carrier.

20 Claims, 13 Drawing Sheets

TRANSFER ROLLER 57 · · · URETHANE RUBBER (HIGH POLARITY, SP = 10)

RETARD ROLLER 44 · · · CM (HIGH POLARITY, SP = 9.2)

TRANSFER ROLLER 57 · · · EPDM (LOW POLARITY, SP = 7.8)

RETARD ROLLER 44 · · · EPDM (LOW POLARITY, SP = 7.8)

TRANSFER ROLLER 57 · · · EPDM (LOW POLARITY, SP = 7.8)

RETARD ROLLER 44 · · · CM (HIGH POLARITY, SP = 9.2)

IMAGE FORMING APPARATUS, AND PAPER FEED MEMBERS THEREOF

BACKGROUND OF THE INVENTION

The present invention relates to an image forming apparatus, such as an electrophotographic copier or a printer, and paper feed members thereof. More particularly, the present invention relates to an image forming apparatus and its paper feed members arranged such that a transfer member transfers a toner image formed on an image carrier to an image record sheet.

In an image forming apparatus, a transfer roller, a transfer pad, and a transfer belt, all of which are pressed against the surface of an image carrier, are known as the transfer member. This type of image forming apparatus is provided with a paper feed device for taking sheets for image forming purposes out of a paper feed tray, and carries the thus-taken sheets one by one to a transfer member provided in a downstream direction. In the paper feed unit, there are commonly used a pickup paper member (a pickup roller) for taking sheets for image forming purposes out of a paper feed tray, paper feed members (e.g., a feed roller, a feed belt, or the like) for conveying the sheets taken out by the pickup paper member one by one by separating the sheets from one another in a frictional way, and paper feed members for supporting purposes (a retard roller, a belt, or a pad) which come into contact with the paper feed member for conveying purposes.

For example, a so-called low-polarity rubber material, such as an ethylene-propylene-diene (EPDM) rubber, a silicon rubber, a natural rubber, or an isoprene rubber, has been used as the rubber material that forms the paper feed members such as the pickup roller, the feed roller, or the retard roller. Further, a urethane rubber or an EPDM has been used as the rubber material that forms the transfer roller. Currently, because of its stability with respect to variations in the ambient, a urethane rubber is chiefly used as the rubber material of the transfer roller.

In the image forming apparatus having the transfer roller made of a urethane rubber, imperfections will often arise in the case where the paper feed members (i.e., the pickup roller, the feed roller, or the retard roller) are made of the low-polarity rubber material.

Through studies and research on the reason why imperfections are liable to arise in the image, inventors of the present invention have elucidated the cause and mechanism of occurrence of imperfections in an image.

More specifically, it has been determined that contaminants which become attached to the sheet after having been scraped away from the surface of the paper feed member become attached to the transfer member in a frictional way, and the contaminants are further transferred to the surface of the image carrier, thereby resulting in imperfections in an image such as fog. It has been found that the imperfections in an image greatly depend on the polarity of the contaminants.

According to the studies performed by the inventors, it has been determined that the polarity of the contaminants which induce imperfections in an image does not really depend on the polarity of a compounding agent, such as a softening agent, included in the rubber material of the paper feed member but depend on the polarity of oligomer inherently originated from the rubber material before it is crosslinked.

With reference to FIGS. 13A, 13B, and 14A to 14C, the mechanism of occurrence of imperfections (or fog) in an image will be described.

In FIGS. 13A and 13B, image record sheets 01 taken out of a paper feed tray by a pickup roller are separated from each other one by one in a frictional way by means of a feed roller 02*a* (for conveying purposes) and a retard roller 02*b* (for supporting purposes) which are in pressed contact with each other. The thus-separated sheet is conveyed to a transfer area Q3 (formed in the area where a transfer roller 03 comes into pressed contact with an image carrier 04). In this event, a trace amount of contaminants represented by O become attached to the sheet 01 from the paper feed members 02*a* and 02*b*.

At this time, in order for the retard roller 02*b* to apply a brake to the sheet 01, the difference between the sheet 01 and the outer peripheral surface of the feed roller 02*a* becomes smaller than the difference in speed between the sheet 01 and the outer peripheral surface of the retard roller 02*b*. More specifically, there is a small amount of slippage between the feed roller 02*a* and the sheet 01, whilst there is a large amount of slippage between the retard roller 02*b* and the sheet 01. For this reason, the amount of contaminants that are removed from the surface of the feed roller 02*a* and then become attached to the sheet 01 is smaller than that of the contaminants that are removed from the surface of the retard roller 02*b* and then become attached to the sheet 01. FIG. 13A is an illustration in which emphasis is placed on the amount of the contaminants attached to the sheet 01 from the paper feed members 02*a* and 02*b*.

In FIG. 13B, the travel speed of the sheet 01 in a transfer area Q3 is usually set to be substantially the same as the peripheral speed of the image carrier (a photosensitive element) 04. The peripheral speed of the transfer roller 03 is usually set to be faster than the travel speed of the sheet 01 by several percentages. For this reason, there is no slippage between the image carrier 04 and the sheet 01, whereas there is slippage between the transfer roller 03 and the sheet 01.

Consequently, when the sheet 01, having the contaminants attached thereto, is transferred to the transfer area Q3, the contaminants are prevented from moving to the surface to the image carrier 04. However, since the transfer roller 03 comes into contact with the surface of the sheet to be brought into contact with the retard roller 02b, the contaminants attached to the sheet 01 are transferred to the transfer roller 03 in a frictional way.

The urethane rubber possesses a high polarity, and paper or OHP paper which is commonly used as the sheet and comprises cellulose as a major constituent, also has a high polarity. Therefore, both the conventional transfer roller 03 made of urethane rubber and the commonly-used sheet 01 have a high polarity.

In contrast, the conventional retard roller 02b is formed from a low-polarity rubber material such as an EPDM. As previously described, the contaminants attached to the surface of the sheet to be brought into contact with the transfer roller 03 also have a low polarity. In general, it is known that there is high compatibility between the substances possessing an identical polarity, whereas there is low compatibility between the substances possessing different polarities.

In FIG. 14A, the transfer roller 03 comes into direct contact with the image carrier 04 before the next sheet 01 arrives at the transfer roller 03 after the sheet 01 has passed through the transfer roller 03 (i.e., during an inter-image period). At this time, there is a difference in peripheral speed between the transfer roller 03 and the image carrier 04. Further, the urethane rubber of the transfer roller 03 is different in polarity from the contaminants attached to the transfer roller 03. Therefore, the contaminants attached to the transfer roller 03 partially move to the image carrier 04. These contaminants gradually accumulate on the surface of the image carrier 04 without being completely cleaned through operation of the image forming apparatus carried out over a long period of time.

In FIG. 14B, during the course of travel of the contaminants attached to the surface of the image carrier 04 through a development area, toner represented by ● becomes attached to the contaminants provided on the image carrier 04. In FIG. 14C, the toner attached to the surface of the contaminants provided on the image carrier 04 is transferred to the next conveyed sheet 01, thereby resulting in background fog.

SUMMARY OF THE INVENTION

The present invention has been conceived in terms of the aforesaid drawback in the related art, and the object of the invention is to prevent imperfections (background fog) from arising in an image as a result of attachment of the contaminants attached to the surface of the sheet (001) to the image carrier via a transfer member.

The present invention conceived to solve the previously described drawback will now be described. To provide a clear correlation between the elements of the present invention and elements of preferred embodiments which will be described later, reference numerals used to designate the elements of the embodiments are also used for corresponding elements of the present invention, but they are parenthesized. The description of the present invention referring to the reference numerals of the preferred embodiments is intended to provide a better understanding of the present invention. Hence, it should be construed that the present invention not be limited to illustrative embodiments.

(Present Invention)

To solve the aforementioned drawback, the present invention is applicable for an image forming apparatus and paper feed members of a paper feed unit of the image forming apparatus comprising:

toner image forming means (11 to 14 and 16) for forming a toner image on the surface of an image carrier (13);

a transfer member (57) which is disposed in a transfer area (Q3) along the surface of the image carrier (13) and transfers the toner image from the surface of the image carrier (13) to the surface of an image record sheet that passes the transfer area (Q3) while it is pressed against the surface of the image carrier (13);

a paper feed unit (41) having paper feed members (42 to 44) which are brought into frictional contact with the sheets loaded in paper feed trays (21 to 24) and carry one of the sheets toward the transfer member (57);

a sheet conveyor unit (27 and 28) for carrying the sheet having passed through the paper feed unit (41) to the transfer area (Q3).

As the transfer member (57), there can be used a pressure-transfer member which transfers an image by use of only pressure or a pressure-contact member which transfers an image by use of combination of pressure and a bias voltage.

(First Invention)

The image forming apparatus according to a first aspect of the present invention, is characterized by comprising:

the paper feed member (42, 43, or 44) which comes into contact with the surface of the sheet to be brought into contact with the transfer member (57) and is formed from rubber material having a solubility parameter of greater than or equal to 8.2 $(cal/cm^3)^{1/2}$.

(Second Invention)

The image forming apparatus according to a second aspect of the present invention, is characterized by comprising:

the paper feed member (42, 43, or 44) which comes into contact with the surface of the sheet to be brought into contact with the transfer member (57) and is formed from rubber material having a dielectric constant of greater than or equal to 4.5 measured by application of a.c. 50 Hz to the paper feed member.

(Third Invention)

The image forming apparatus according to a third aspect of the present invention, is characterized by comprising:

the paper feed member (42, 43, or 44) which comes into contact with the surface of the sheet to be brought into contact with the transfer member (57) and is formed from rubber material having a substituent other than hydrocarbon radicals attached to the principal polymer chain.

(Fourth Invention)

The image forming apparatus according to a fourth aspect of the present invention, is characterized by comprising:

the transfer member formed from rubber material having a solubility parameter of smaller than 8.2 $(cal/cm^3)^{1/2}$; and the paper feed member (42, 43, or 44) which comes into contact with the surface of the sheet to be brought into contact with the transfer member (57) and is formed from rubber material having a solubility parameter of smaller than 8.2 $(cal/cm^3)^{1/2}$.

(Fifth Invention)

The image forming apparatus according to a fifth aspect of the present invention, is characterized by comprising:

the paper feed member (42, 43, or 44) which comes into contact with the surface of the sheet to be brought into contact with the transfer member (57) and is formed from rubber material having a solubility parameter of greater than or equal to 8.2 $(cal/cm^3)^{1/2}$.

(Sixth Invention)

The image forming apparatus according to a sixth aspect of the present invention, is characterized by comprising:

the paper feed member (42, 43, or 44) which comes into contact with the surface of the sheet to be brought into contact with the transfer member (57) and is formed from rubber material having a dielectric constant of greater than or equal to 4.5 measured by application of a.c. 50 Hz to the paper feed member.

(Seventh Invention)

The image forming apparatus according to a seventh aspect of the present invention, is characterized by comprising:

the paper feed member (42, 43, or 44) which comes into contact with the surface of the sheet to be brought into contact with the transfer member (57) and is formed from rubber material having a substituent other than hydrocarbon radicals attached to the principal polymer chain.

(Eighth Invention)

The image forming apparatus according to an eighth aspect of the present invention, is characterized by comprising:

the transfer member formed from rubber material having a solubility parameter of smaller than 8.2 $(cal/cm^3)^{1/2}$, and the paper feed member (42, 43, or 44) which comes into contact with the surface of the sheet to be brought into contact with the transfer member (57) and is formed from rubber material having a solubility parameter of smaller than 8.2 $(cal/cm^3)^{1/2}$.

The present invention will be described in detail hereinbelow.

A solubility parameter (SP) δ represented by Equation (1) given below is enumerated as one index for designating the previously-described "polarity" of a substance. In general, the larger SP value, the polarity of the substance increases.

$$\delta^2=\delta^2 d+\delta^2 p'+\delta^2 h \quad (1)$$

(where δd, δp', and δh are each an SP in terms of a dispersion force, the effect of polarity, and hydrogen bonding).

The SP (δ) can be represented by Equation (2) given below, provided that a cohesive energy is E (cal.) and a molecular volume is Vm ($cm^3$).

$$\delta=(E/Vm)^{1/2} \quad (2)$$

Throughout the specification, a material having an SP of greater than or equal to 8.2 $(cal/cm^3)^{1/2}$ will be referred to as a high-polarity material, whereas a material having an SP of less than 8.2 $(cal/cm^3)^{1/2}$ will be referred to as a low-polarity material.

In the present invention, a resilient material having a substituent other than hydrocarbon radicals attached to the principal polymer chain is used as the high-polarity rubber material which has an SP of greater than or equal to 8.2 $(cal/cm^3)^{1/2}$ (hereinafter the unit of the SP will be omitted) and is used for the paper feed member that comes into frictional contact with the sheet when the sheets are conveyed from the paper feed trays (21 to 24) to the transfer section.

As the substituent, there are enumerated atoms of chlorine, nitrogen, or oxygen which are directly bonded to the principal polymer chain, or atoms of chlorine, nitrogen, or oxygen bonded to hydrocarbon radicals branched out from the principal polymer chain. For example, a cyano group is enumerated as atoms of nitrogen, and atoms of oxygen may be included in an ester group or a sulfonic group. Further, as hydrocarbon radicals which atoms of nitrogen or oxygen attach, there may be enumerated an alkyl group such as a methyl group, a cycloalkyl group such as a cyclohexyl group, an allyl group such as a phenyl group, or an aralkyl group such as a benzyl group.

An NBR (acrylonitrile-butadiene rubber; a SP of 8.7 to 10.4), a CR (chloroprene rubber; 8.7 to 9.3), a CSM (chlorosulfonated ethylene; 8.9), a CM (chlorinated polyethylene rubber; 9.2 to 9.3), or a U (Urethane rubber; 10) may be enumerated as the high-polarity rubber. It is possible to use the rubbers by blending two or more types of rubber materials with each other. When measured while an a.c. of 50 Hz is applied to the rubber material, the dielectric constant of the rubber material having an SP of greater than or equal to 8.2 is greater than or equal to 4.5.

An Si rubber (silicon rubber; an SP of 7.3 to 7.6), an EPDM (an SP of 7.8 to 7.9), an NR (natural rubber; 8.13), an IIR (butyl rubber; 7.7 to 8.1), or an PNR (polynolbornane rubber; 8.1) may be enumerated as the rubber material having an SP value lower than 8.2.

The present invention can be applied to a paper feed member for supporting purposes made of a roller, a belt, or a pad, a paper feeder for conveying purposes made of a roller or a belt, or a pickup conveyor member formed from rotating members such as pickup rollers used when taking out a sheet from paper-feed trays (21 to 24).

A transfer roller, a contact pad, or a transfer belt may be used as the transfer member (57). This transfer member (57) is provided so as to create a difference between the travel speed of the sheet and the peripheral speed of the image carrier (13). For example, in a case where the transfer member (57) is a contact pad, the contact pad is pressed only against the surface of the image carrier (13). Hence, the difference between the travel speed of the sheet and the peripheral speed of the image carrier (13) is large. The contact pad scrapes the sheet conveyed to the transfer area, and hence contaminants move to the contact pad when the contact pad comes into contact with the surface of the sheet having the contaminants attached thereon.

It is possible to use various types of rubber materials ranging from a low-polarity silicon rubber having an SP of 7.3 to 7.6 to a high-polarity urethane rubber having an SP of 10. However, in a case where the paper feed members (42 to 44) are formed from a low-polarity rubber material, it is necessary to avoid the use of a high-polarity rubber material.

A drum or belt-shaped image carrier can be used as the image carrier (13). An organic photosensitive element coated with polycarbonate or an inorganic photosensitive element having amorphous silicon formed thereon, may be used as the image carrier (13). Polycarbonate or amorphous silicon forming the surface of the image carrier has a low polarity, and hence it is difficult for the contaminants having a high polarity to become attached to the surface.

Therefore, in the case of use of the image carrier (13) having a low-polarity surface, it is possible to extend the life of the surface of the image carrier (13) by adoption of a structure which enables occurrence of high-polarity contaminants.

The operation of the present invention having the aforementioned features will be described.

(Operation of the First Invention)

In the image forming apparatus according to the first aspect of the present invention having the previously-described features, the toner image forming means (11 to 14 and 16) form a toner image on the surface of the image carrier (13).

The paper feed members (42 to 44) of the paper feed unit (41) come into frictional contact with the sheets loaded in the paper feed trays (21 to 24) and convey one of the sheets toward the transfer member (57).

The sheet conveyer unit (27 and 28) conveys the sheet having passed through the paper feed unit (41) to the transfer area (Q3).

The transfer member (57) disposed in the transfer area (Q3) along the surface of the image carrier (13) transfers a toner image from the surface of the image carrier (13) to the surface of an image record sheet which passes through the transfer area (Q3) while being pressed against the surface of the image carrier (13).

In addition to the rubber raw material (an unvulcanized polymer), a compounding agent such as a softening agent including a plasticizer, a filler including a conductive agent, a vulcanizing agent, a vulcanizing acceleration agent, or an age resistor is used for the rubber material of the transfer member or roller (57) and the paper feed members (42 to 44). It is known that, in particular, a softening agent seeps, as contaminants, through the surface of the rubber roller such as the transfer roller (57) or the paper feed members (42 to 44) as a result of operation of the image forming apparatus over a long period of time. Consequently, it has been conceived that the contaminants are mainly originated from the softening agent included in the rubber material. For example, if a softening agent included in the rubber material that forms the paper feed members (42 to 44) and forcibly scrapes the sheet has a low polarity, it is apt to be deemed that the contaminants which are scraped away from the surface of the paper feed members (42 to 44) and become then attached to the sheet have a low polarity.

However, according to the studies performed by the inventors of the present invention, most of the contaminants-which become attached to the sheet after having been scraped away from the surface of the paper feed members (42 to 44) and cause imperfections in an image are oligomer. In short, the polarity of the contaminants does not really depend on the polarity of the softening agent included in the rubber material forming the paper feed members (42 to 44) but inherently depends on the polarity of the oligomer.

In the present invention, the sheet scrapes the surface of the paper feed members (42 to 44), and hence contaminants scraped away from the surface of each of the paper feed members (42 to 44) become attached to the surface of the sheet.

Of the paper feed members (42 to 44), the paper feed member which comes into contact with the surface of the sheet to be brought into contact with the transfer member (57) is formed from the rubber material having an SP of greater than or equal to 8.2. Consequently, the contaminants which are scraped by the paper feed member (42, 43, or 44) that comes into contact with the surface of the sheet to be brought into contact with the transfer member (57) have an SP of greater than or equal to 8.2. The contaminants having an SP of greater than or equal to 8.2 are scraped by the transfer member (57) and attach to the transfer member (57).

Since the contaminants attached to the transfer member (57) have an SP of greater than or equal to 8.2, it is firmly adsorbed by at least either the sheet (paper) having a high polarity or the transfer member (57) formed from high-polarity rubber. As a result, it becomes difficult for the contaminants to move to the surface of the image carrier (13). Further, contaminants are scraped away from the paper feed member of the paper feed members (42 to 44) which comes into contact with the surface of the sheet to be brought into contact with the image carrier (13). The surface of the sheet having such contaminants attached thereto comes into contact with the surface of the image carrier (13). However, since the travel speed of the sheet and the peripheral speed of the image carrier (13) are equal to each other, the contaminants do not become substantially attached to the image carrier (13).

Therefore, imperfections in picture quality due to the contaminants do not arise.

(Operation of the Second Invention)

In the image forming apparatus according to the second invention of the present patent application having the previously described features, the paper feed member (42, 43, or 44) which comes into contact with the surface of the sheet to be brought into contact with the transfer member (57) of the paper feed unit (41) is formed from the rubber material. The rubber material has a dielectric constant of greater than or equal to 4.5 which is measured by application of a.c. of 50 Hz to the paper feed member. The sheet comes into frictional contact with the surface of the paper feed member (42, 43, or 44), and therefore the contaminants scraped away from the surface of each of the paper feed members (42 to 44) become attached to the surface of the sheet. The contaminants which become attached to the sheet after having been scraped away from the paper feed member of the paper feed members (42 to 44) that comes into contact with the surface of the sheet to be brought into contact with the transfer member (57) have a dielectric constant of greater than or equal to 4.5. The contaminants which become attached to the sheet and have a dielectric constant of greater than or equal to 4.5 measured by application of a.c. of 50 Hz to the contaminants become attached to the transfer member (57) by scraping.

The contaminants attached to the transfer member (57) have a dielectric constant of greater than or equal to 4.5 measured by application of a.c. of 50 Hz to the contaminants. The SP of the contaminants shows a high polarity, and hence the contaminants do not substantially become attached to the surface of the image carrier (13) as in the case of the first embodiment.

(Operation of the Third Invention)

In the image forming apparatus of the third invention of the present patent application having the previously described features, the paper feed member (42, 43, or 44) of the paper feed unit (41) which comes into contact with the surface of the sheet to be brought into contact with the transfer member (57) is formed from the rubber material which has a substituent other than hydrocarbon radicals attached to the principal polymer chain. Since the sheet comes into frictional contact with the surface of each of the paper feed members (42 to 44), the contaminants scraped away from the surface of each of the paper feed members (42 to 44) become attached to the surface of the sheet. The contaminants which become attached to the sheet after having been scraped away from the paper feed member that comes into contact with the surface of the sheet to be brought into contact with the transfer member (57) are estimated to be oligomer. This oligomer is originated from the rubber material which has a substituent other than hydrocarbon radicals attached to the principal polymer chain. The contaminants which become attached to the surface of the sheet and are estimated to be oligomer become attached to the transfer member (57) by scraping.

The contaminants attached to the transfer member (57) are oligomer and have an SP of greater than or equal to 8.2; i.e., a high polarity. Therefore, as in the case of the first embodiment, the contaminants do not substantially become attached to the surface of the image carrier (13).

(Operation of the Fourth Invention)

In the image forming apparatus of the fourth invention of the present patent application having the previously described features, the paper feed member (42, 43,or 44) of the paper feed unit (41) which comes into contact with the surface of the sheet to be brought into contact with the transfer member (57) and the transfer member (57) are formed from the rubber material having an SP of smaller than 8.2. The sheet comes into frictional contact with the surface of the paper feed member (42, 43, or 44), and therefore the contaminants scraped away from the surface of each of the paper feed members (42 to 44) attach to the surface of the sheet. The contaminants which become attached to the sheet after having been scraped away from the paper feed member of the paper feed members (42 to 44) that comes into contact with the surface of the sheet to be brought into contact with the transfer member (57) have an SP of smaller than 8.2. The contaminants which become attached to the surface of the sheet and have an SP of smaller than 8.2 attach to the transfer member (57) by scraping.

Since the contaminants attached to the transfer member (57) have an SP of smaller than 8.2, it is firmly adsorbed by the transfer member (57) which is formed from a low-polarity rubber material having an SP of smaller than 8.2. Therefore, it is difficult for the contaminants to move to the image carrier (13).

The contaminants are scraped away from the paper feed member of the paper feed members (42 to 44) which comes into contact with the surface of the sheet to be brought into contact with the image carrier (13). The surface of the sheet having such contaminants-attached thereto comes into contact with the surface of the image carrier (13). However, since the travel speed of the sheet and the peripheral speed of the image carrier (13) are equal to each other, the contaminants do not substantially become attached to the image carrier (13).

(Operation of the Fifth to Eighth Invention)

The paper feed member which is used in the paper feed unit of the image forming apparatuses of the fifth to eighth invention of the present patent application having the previously described features operates in the same way as do the paper feed members of the first to fourth invention, and hence its explanation will be omitted here.

<First Embodiment of the First Invention>

The image forming apparatus according to a first embodiment of the first invention of the present patent application is characterized by comprising:

(A6) the paper feed member (42) of the paper feed unit (41) is a pickup paper feed member (42) which comes into frictional contact with the upper surface of the sheet loaded in the paper feed tray so as to take the sheet out of the paper feed tray.

(Operation of the First Embodiment of the First Invention)

In the image forming apparatus of the first embodiment of the first invention of the present patent application having the previously described features, the surface of the pickup paper feed member (42) which is disposed so as to come into contact with the surface of the sheet to be brought into contact with the transfer member (57) is scraped by the sheet. Consequently, the contaminants scraped away from the surface of the pickup paper feed member (42) become attached to the surface of the sheet. The contaminants which become attached to the sheet after having been scraped away from the surface of the paper feed member (42) that comes into contact with the surface of the sheet to be brought into contact with the transfer member (57) have an SP of greater than or equal to 8.2. The contaminants having an SP of greater than or equal to 8.2 are scraped by the transfer member (57) and attach to the transfer member (57).

Since the contaminants attached to the transfer member (57) have an SP of greater than or equal to 8.2, it is difficult for the contaminants to move to the surface of the image carrier (13) for the same reasons as those of the first invention. Further, the contaminants which are scraped away from the paper feed member of the paper feed members (43 and 44) that comes into contact with the surface of the sheet to be brought into contact with the image carrier (13) do not substantially become attached to the image carrier (13) for the same reasons as those of the first invention.

<Second Embodiment of the First Invention>

The image forming apparatus according to a second embodiment of the first invention of the present patent application is characterized by comprising:

(A7) the paper feed member (43) of the paper feed unit (41) is a paper feed member (43) for conveying purposes which comes into frictional contact with one surface of the sheet taken out of the paper feed tray so as to exert a conveying force on the sheet.

(Operation of the Second Embodiment of the First Invention)

In the image forming apparatus of the second embodiment of the first invention of the present patent application having the previously described features, the surface of the conveyor paper feed member (43) which is disposed so as to come into contact with the surface of the sheet to be brought into contact with the transfer member (57) is scraped by the sheet. Consequently, the contaminants scraped away from the surface of the conveyor paper feed member (43) become attached to the surface of the sheet. The contaminants that become attached to the sheet after having been scraped away from the surface of the conveyor paper feed member (43) which comes into contact with the surface of the sheet to be brought into contact with the transfer member (57) have an SP of greater than or equal to 8.2. The contaminants having an SP of greater than or equal to 8.2 are scraped by the transfer member (57) and attach to the transfer member (57).

The contaminants attached to the transfer member (57) are difficult to move to the surface of the image carrier (13) for the same reasons as those of the first invention. Further, the contaminants which are scraped away from one or both of the paper feed members (43 and 44) that comes into contact with the surface of the sheet to be brought into contact with the image carrier (13) do not substantially become attached to the image carrier (13) for the same reasons as those of the first invention.

<Third Embodiment of the First Invention>

The image forming apparatus according to a third embodiment of the first invention of the present patent application is characterized by comprising:

(A8) the paper feed member (44) of the paper feed unit (41) is a paper feed member (44) for supporting purposes which comes into frictional contact with one surface of the sheet taken out of the paper feed tray so as to apply a brake to the sheet.

(Operation of the Third Embodiment of the First Invention)

In the image forming apparatus of the third embodiment of the first invention of the present patent application having the previously described features, the surface of the supporting paper feed member (44) which is disposed so as to come into contact with the surface of the sheet to be brought into contact with the transfer member (57) is scraped by the sheet. Consequently, in contrast to the amount of contaminants which are scraped away from the pickup paper feed member (42) and the conveyor paper feed member (43) and become attached to the sheet, a larger amount of the contaminants scraped away from the surface of the supporting paper feed member (44) become attached to the surface of the sheet. The contaminants which become attached to the sheet after having been scraped away from the surface of the supporting paper feed member (44) that comes into contact with the surface of the sheet to be brought into contact with the transfer member (57) have an SP of greater than or equal to 8.2. The contaminants having an SP of greater than or equal to 8.2 are scraped by the transfer member (57) and become attached to the transfer member (57).

The contaminants attached to the transfer member (57) are difficult to move to the surface of the image carrier (13) for the same reasons as those of the first invention. Further, the contaminants scraped away from one or both of the paper feed members (42 and 43) which comes into contact with the surface of the sheet to be brought into contact with the image carrier (13), do not substantially become attached to the image carrier (13) for the same reasons as those of the first invention.

<Fourth Embodiment of the First Invention>

The image forming apparatus of a fourth embodiment, as defined in the first invention or in any one of the first to third embodiments of the first invention of the present patent application, is characterized by comprising:

(A9) the transfer member (57) is formed from the rubber material having a solubility parameter of greater than or equal to 7.8 $(cal/cm^3)^{1/2}$ and smaller than or equal to 10 $(cal/cm^3)^{1/2}$.

(Operation of the Fourth Embodiment of the First Invention)

In the image forming apparatus of the fourth embodiment of the first invention of the present patent application having the previously described features, the transfer member (57) is formed from the rubber material having a solubility parameter of greater than or equal to 7.8 $(cal/cm^3)^{1/2}$ and smaller than or equal to 10 $(cal/cm^3)^{1/2}$. Further, the rubber material of the paper feed member which comes into contact with the surface of the sheet to be brought into contact with the transfer member (57) has an SP of greater than or equal to 8.2.

In general, there is compatibility between the substances possessing an identical polarity, whereas there is not any compatibility between the substances possessing different polarities. More specifically, if the transfer member (57) is formed from the rubber material having an SP of greater than or equal to 8.2, the contaminants originated from the rubber material of the paper feed member are firmly adsorbed by the transfer member (57) because the transfer member (57) and the rubber material of the paper feed member have the same polarity. Further, if the transfer member (57) is formed from the rubber material having an SP of smaller than 8.2, the rubber material of the paper feed member which comes into contact with the surface of the sheet to be brought into contact with the transfer member (57) has the same polarity as that of the high-polarity sheet (paper), whereby the contaminants are firmly adsorbed by the sheet.

Therefore, it becomes difficult for the contaminant adhered to the transfer member (57) to move to the surface of the image carrier (13).

<Fifth Embodiment of the First Invention>

The image forming apparatus of a fifth embodiment, as defined in the fourth embodiment of the first invention of the present patent application, is characterized by comprising:

(A10) the rubber material of the transfer member (57) is urethane rubber.

(Operation of the Fifth Embodiment of the First Invention)

In the image forming apparatus of the fifth embodiment of the first invention of the present patent application having the previously described features, the urethane rubber forming the transfer member (57) has an SP of 10 and, hence, a high polarity. If such a transfer member (57) is used, the image forming apparatus of the fifth embodiment performs the same operation as does the image forming apparatus of the fourth embodiment of the first invention wherein the transfer member (57) and the rubber material of the paper feed member which comes into contact with the surface of the sheet to be brought into contact with the transfer member (57).

<Sixth Embodiment of the First Invention>

The image forming apparatus of a sixth embodiment, as defined in the fourth embodiment of the first invention of the present patent application, is characterized by comprising:

(A11) the rubber material of the transfer member (57) is EPDM.

(Operation of the Sixth Embodiment of the First Invention)

In the image forming apparatus of the sixth embodiment of the first invention of the present patent application having the previously described features, the EDPM forming the transfer member (57) has an SP of 7.8 to 7.9 and, hence, a low polarity. If the transfer member (57) from such a low-polarity rubber material is used, the image forming apparatus of the sixth embodiment performs the same operation as does the image forming apparatus of the first embodiment of the first invention wherein the contaminants are firmly adsorbed by the sheet.

<Seventh Embodiment of the First Invention>

The image forming apparatus according to a seventh embodiment of the first invention of the present patent application is characterized by comprising:

(A12) the image carrier (13) which is formed from a photosensitive element covered with polycarbonate.

(Operation of the Seventh Embodiment of the First Invention)

In the image forming apparatus of the seventh embodiment of the first invention of the present patent application having the previously described features, the image carrier (13) is formed from a photosensitive element covered with polycarbonate. Polycarbonate is resin having superior abrasion resistance and therefore is capable of preventing imperfections in picture quality due to abrasion of the surface of the image carrier (13) over a long period of time.

Since the polycarbonate has a low polarity, high-polarity contaminants attached to the transfer member (57) are difficult to attach to the surface of the image carrier (13) coated with the low-polarity polycarbonate. In short, if a high-polarity rubber material is used for the paper feed members (42 to 44), the contaminants attached to the transfer member (57) have a high polarity. It is difficult for the contaminants to move to the image carrier (13) regardless of whether the transfer member (57) is formed from a low-polarity rubber material or a high-polarity rubber material.

<First Embodiment of the Second Invention>

The image forming apparatus according to a first embodiment of the second invention of the present patent application is characterized by comprising:

(B6) the paper feed member (42) of the paper feed unit (41) is a pickup paper feed member (42) which comes into frictional contact with the upper surface of the sheet loaded in the paper feed tray so as to take the sheet out of the paper feed tray.

The image forming apparatus of the first embodiment of the second invention performs the same operation as that of the image forming apparatus of the first embodiment of the first invention.

<Second Embodiment of the Second Invention>

The image forming apparatus according to a second embodiment of the second invention of the present patent application is characterized by comprising:

(B7) the paper feed member (43) of the paper feed unit (41) is a paper feed member (43) for conveying purposes which comes into frictional contact with one surface of the sheet taken out of the paper feed tray so as to exert a conveying force on the sheet.

The image forming apparatus of the second embodiment of the second invention performs the same operation as that of the image forming apparatus of the second embodiment of the first invention.

<Third Embodiment of the Second Invention>

The image forming apparatus according to a third embodiment of the second invention of the present patent application is characterized by comprising:

(B8) the paper feed member (44) of the paper feed unit (41) is a paper feed member (44) for supporting purposes which comes into frictional contact with one surface of the sheet taken out of the paper feed tray so as to apply a brake to the sheet.

The image forming apparatus of the third embodiment of the second invention performs the same operation as that of the image forming apparatus of the third embodiment of the first invention.

<Fourth Embodiment of the Second Invention>

The image forming apparatus of a fourth embodiment, as defined in the second invention or in any one of the first to third embodiments of the second invention of the present patent application, is characterized by comprising:

(B9) the transfer member (57) is formed from the rubber material having a solubility parameter of greater than or equal to 7.8 $(cal/cm^3)^{1/2}$ and smaller than or equal to 10 $(cal/cm^3)^{1/2}$.

The image forming apparatus of the fourth embodiment of the second invention performs the same operation as that of the image forming apparatus of the fourth embodiment of the first invention.

<Fifth Embodiment of the Second Invention>

The image forming apparatus of a fifth embodiment, as defined in the fourth embodiment of the second invention of the present patent application, is characterized by comprising:

(B10) the rubber material of the transfer member (57) is urethane rubber.

The image forming apparatus of the fifth embodiment of the second invention performs the same operation as that of the image forming apparatus of the fifth embodiment of the first invention.

<Sixth Embodiment of the Second Invention>

The image forming apparatus of a sixth embodiment, as defined in the fourth embodiment of the second invention of the present patent application, is characterized by comprising:

(B11) the rubber material of the transfer member (57) is EPDM.

The image forming apparatus of the sixth embodiment of the second invention performs the same operation as that of the image forming apparatus of the sixth embodiment of the first invention.

<Seventh Embodiment of the Second Invention>

The image forming apparatus according to a seventh embodiment of the second invention of the present patent application is characterized by comprising:

(B12) the image carrier (13) which is formed from a photosensitive element covered with polycarbonate.

The image forming apparatus of the seventh embodiment of the second invention performs the same operation as that of the image forming apparatus of the seventh embodiment of the first invention.

DETAILED DESCRIPTION OF THE PREFERRED EMBODIMENTS

Although illustrative examples (or embodiments) of the present invention will be described with reference to the accompanying drawings, the present invention will not be limited to these embodiments.

(First Embodiment)

Figure 1:
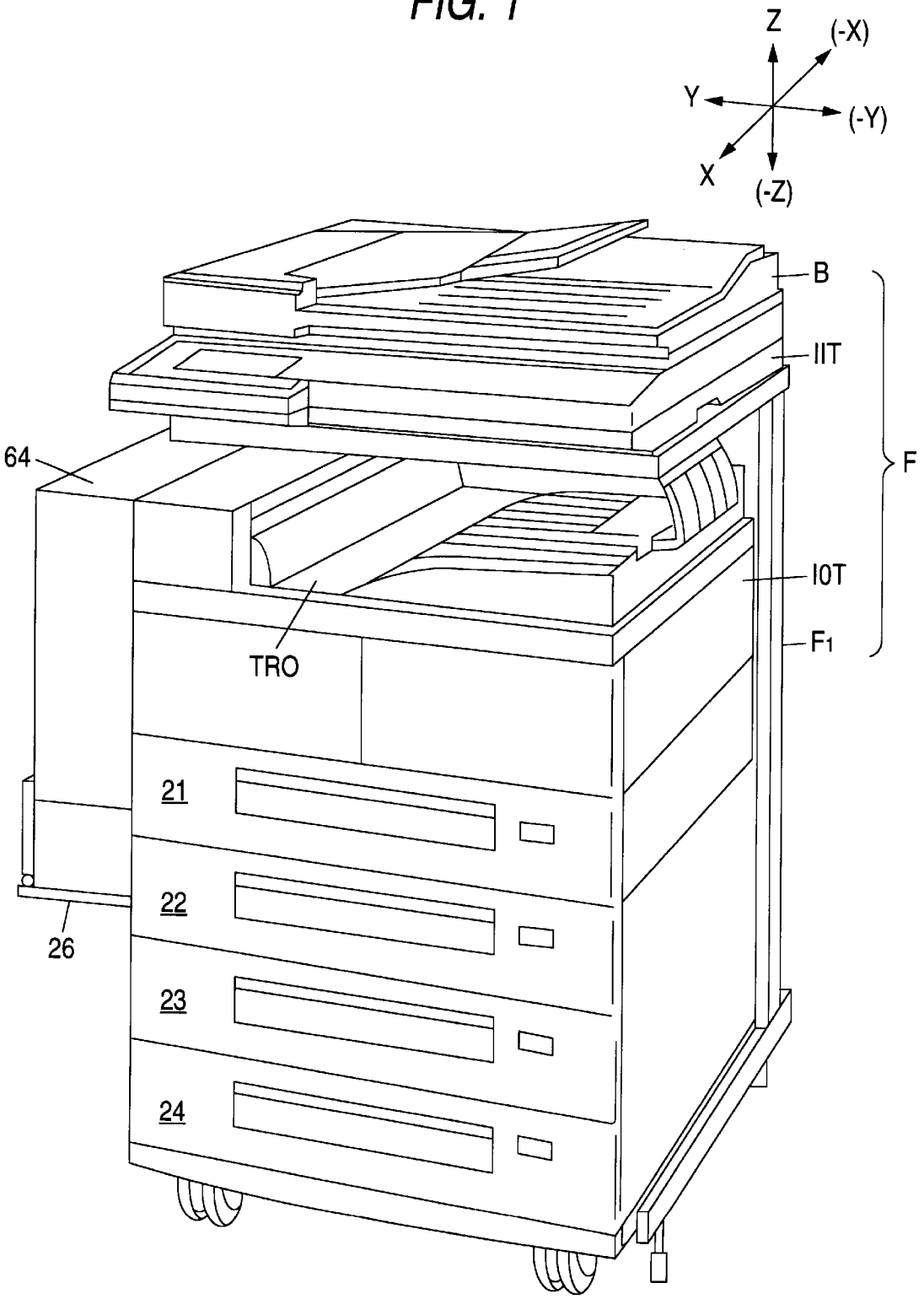
FIG. 1 is a perspective view of the entire image forming apparatus (a digital copier) according to a first embodiment of the present invention.
Figure 2:
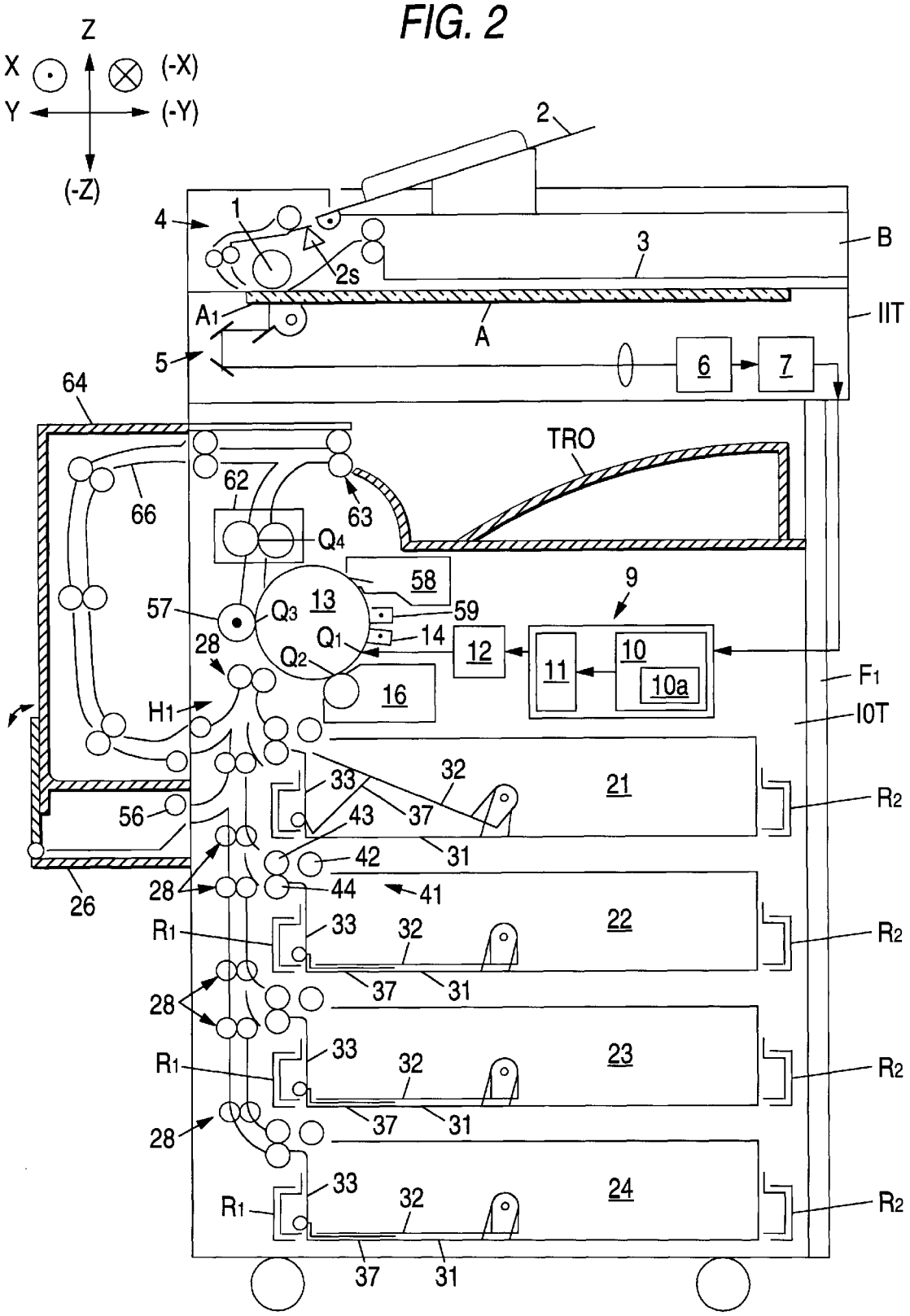
FIG. 2 is a longitudinal cross-sectional view of the digital copier illustrated in FIG. 1.
Figure 3:
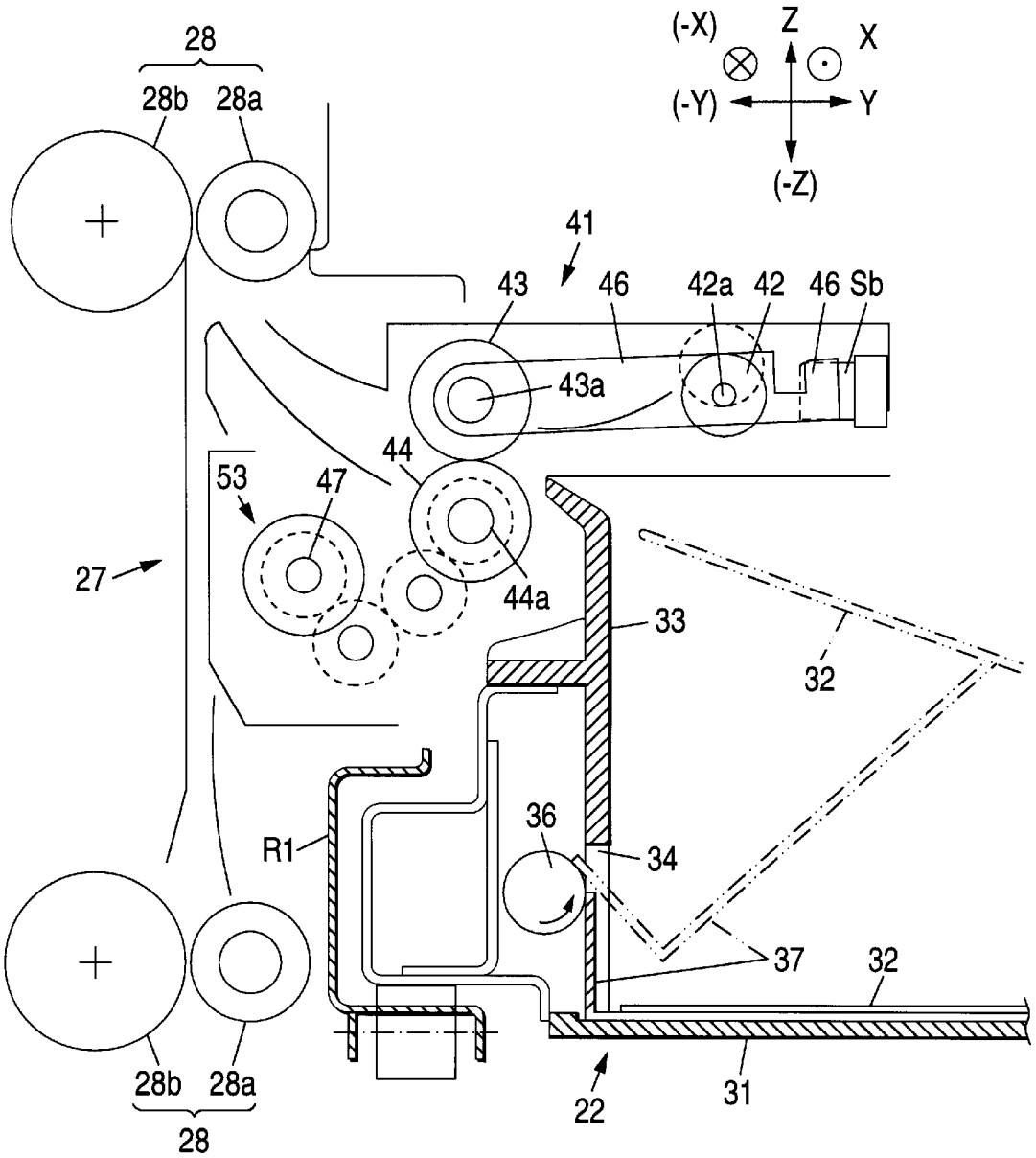
FIG. 3 is an enlarged explanatory view of the paper feed side of a paper feed tray of the first embodiment.
Figure 4:
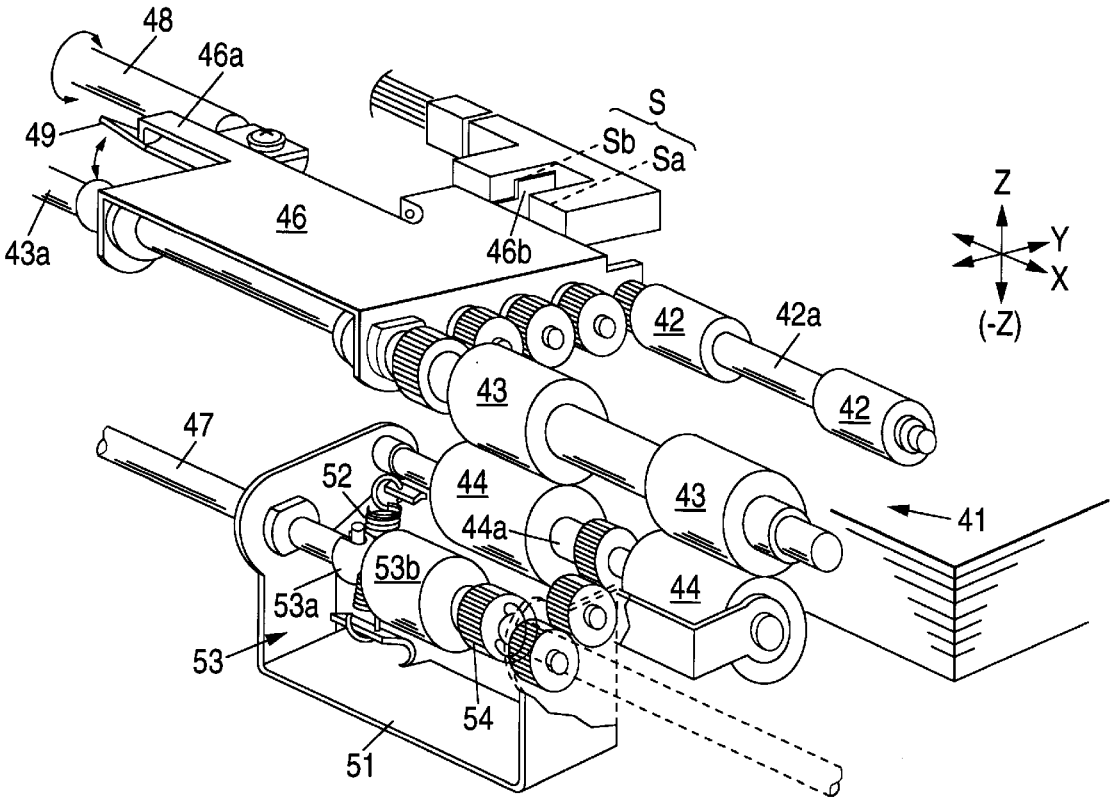
FIG. 4 is a perspective view of a pickup roller and a paper feed unit of the first embodiment.

FIG. 1 is a perspective view of the entire image forming apparatus (a digital copier) according to a first embodiment of the present invention. FIG. 2 is a longitudinal cross-sectional view of the digital copier illustrated in FIG. 1. FIG. 3 is an enlarged explanatory view of the paper feed side of a paper feed tray of the first embodiment. FIG. 4 is a perspective view of the pickup roller and the paper feed unit of the first embodiment.

Throughout the descriptions of the embodiments of the present invention, "forward" represents the direction designated by arrow X in the drawing, whereas "backward" represents the direction designated by arrow (−X) in the drawing. "Leftward" represents the direction designated by arrow Y in the drawing; namely, a leftward direction when an image forming apparatus is viewed from its front to its back. "Rightward" represents the direction designated by arrow (−Y) in the drawing. "Upward" represents the direction designated by arrow Z in the drawing, whereas "downward" represents the direction designated by arrow (−Z) in the drawing. In the drawing, "O" with a dot represents the arrow which passes through a sheet of paper from its rear to its front, whereas "O" with a cross represents the arrow which passes through the sheet of paper from its front to its back.

In FIGS. 1 and 2, the image forming apparatus (a digital copier) F of the first embodiment is provided with an IOT (Image Output Terminal) which is supported by a lower portion of a frame F1, an IIT (Image Input Terminal, or an image read section) supported by an upper portion of the frame Fl, and an automatic original conveyor unit B supported by a platen glass A (see FIG. 2) provided on the IIT.

A sheet discharge tray TRO is disposed on the top of the IOT below the IIT.

In FIG. 2, the automatic original conveyor unit B has a platen roller 1 positioned at an automatic original reading position A1 on the platen glass A. The automatic original conveyor unit B is provided with an original paper feed tray 2, an original sensor 2*s* for detecting the presence or absence of the original placed in the original paper feed tray 2, a sheet discharge tray 3, and an original conveyor 4 for conveying the original taken out of the original paper feed tray 2 to the original sheet discharge tray 3 at a constant travel speed so as to pass the automatic original reading position Al.

The IIT has an exposure scanning optical system 5, and a solid-state image pickup device 6 disposed at the position on which the light reflected from the original placed on the platen glass A converges after having passed through the exposure scanning optical system 5. The solid-state image pickup device 6 has a function of converting into an electrical signal the light converged on an image pickup surface of the pickup device after having been reflected from the original. The IIT has a read data output means 7 which converts the analog electrical signal received from the solid-state image pickup device 5 into a digital signal and outputs the digital signal to the IOT (Image Output Terminal) in the form of image data.

The elements designated by reference numerals 5 through 7 form the image read means IIT of the present invention.

The IOT has an image record control section 9 which processes the image data received from the read data output means 7 of the IIT. The image record control section 9 has an image data storage means 10 for storing the image data to image storage memory 10*a*, and a write image data output means 11 which reads image data from the image storage memory 10*a* and outputs the thus read image data in the form of write data (a laser drive data).

The signal output from the write image data output means 11 is input to an image writing device 12. The image writing device 12 has a function of forming an electrostatic latent image on the surface of an image carrier 13 located in a latent image write position Q1 according to the received write image data by use of a laser beam used for writing an image.

The surface of the image carrier 13 becomes uniformly charged by an electrostatic charger 14. The electrostatic latent image is then formed on the surface of the image carrier 13 in the latent image write position Q1. The electrostatic latent image formed on the surface of the image carrier 13 is developed in the form of a toner image in a development area Q2 by a development unit 16.

The elements designated by reference numerals 11 to 14 and 16 form a toner image forming means (11 to 14 and 16).

The IOT is provided with a plurality of paper feed trays 21 to 24 and a manual paper feed tray 26 for holding image record sheets which are conveyed to the transfer area Q3. Each of the paper feed trays 21 to 24 is supported so as to be able to travel along a pair of rails R1 and R2 provided on both sides of the paper feed tray in the previously described forward and backward directions (i.e., in the direction perpendicular to the surface of paper in FIG. 2).

The sheet taken out of each of the paper feed trays 21 to 24 and 26 is conveyed to the transfer area Q3 along a sheet travel path 27 and sheet conveyor rollers 28 disposed along the sheet travel path 27. The sheet conveyor rollers 28 are made up of drive rollers 28*a* and driven rollers 28*b*.

The sheet travel path 27 and the sheet conveyor rollers 28 form a sheet conveyor unit (27 and 28).

In FIGS. 2 and 3, each of the paper feed trays 21 to 24 has a bottom plate 31, and a sheet load plate 32, on which the sheets will be loaded, is placed on the bottom plate 31. The right end of the sheet load plate 32 is rotatively supported on the bottom surface in the vicinity of both ends of each of the paper feed trays 21 to 24 in the forward and backward directions.

In FIGS. 2 and 3, the front end (the left end in the drawings) of each of the paper feed trays 21 to 24 in the direction in which the sheet is conveyed, is supported by a sheet front end support wall 33. A lever through hole 34 is formed in a lower portion of the sheet front end support wall 33. A sheet raise rotary shaft 36 is provided outside (or on the left side of) the sheet front end support wall 33. One end of an L-shaped sheet raise lever 37 is fitted to the sheet raise rotary shaft 36. The other end (or the right end) of the sheet raise lever 37 is in slidable contact with the lower surface of the sheet load plate 32 through the lever through hole 34.

If the sheet raise rotary shaft 36 is rotated counterclockwise from its position designated by a solid line in FIG. 3, the sheet load plate 32 is raised to the position designated by a two-dot chain line, whereby the upper surface of the sheets loaded on the sheet load plate 32 can be retained at an appropriate pickup position.

In FIGS. 3 and 4, a paper feed unit 41 is provided with a pickup roller 42 serving as a pickup paper feed member, a feed roller 43 serving as a conveying paper feed roller, and a pair of retard rollers 44 serving as supporting conveyor members. A shaft 43*a* of the feed roller 43 is rotatively driven by a drive motor (not shown) disposed behind the image forming apparatus F. A pivot arm 46 rotatively supported by the feed roller shaft 43*a* rotatively supports a pickup roller shaft 42*a* which rotates together with the pickup roller 42 in an integrated fashion. As can be seen from FIG. 4, the pickup roller shaft 42*a* is arranged so as to rotate via a train of gears which rotate together with the rotation of the feed roller shaft 43*a*. When a sheet is taken out of the sheets loaded on the sheet load plate 32, the pivot arm 46 is lowered by gravitation or a weak spring (not shown) so as to come into contact with the upper surface of the sheet.

The lower surface of a raising/lowering action control section 46*a* of the pivot arm 46 (see FIG. 4) is supported by a raising/lowering pivot lever 49 which pivots together with an arm raising/lowering shaft 48 in an integrated fashion. The arm raising/lowering shaft 48 is arranged so as to rotate through a certain angle according to the expansion and contraction of a solenoid (not shown). As can be seen from FIG. 4, as a result of rotation of the arm raising/lowering shaft 48, the raising/lowering pivot lever 49 is retained in an elevated position when the solenoid (not shown) is in an off state. In contrast, when the solenoid is in an on state, the raising/lowering pivot lever 49 is retained in a lowered position. While the raising/lowering pivot lever 49 is retained in a lowered position, the pivot arm 46 downwardly pivots by gravitation or a spring (not shown).

In FIG. 4, the pivot arm 46 has a position control projection leaf 46*b* which extends in a leftward direction (or in the Y direction). The position control projection leaf 46*b* moves vertically according to the pivotal movement of the pivot arm 46. A pivot arm attitude sensor S consisting of light-emitting elements Sa and Sb is positioned such that the travel path of the position control projection leaf 46*b* is sandwiched between the light-emitting elements Sa and Sb in the forward and backward directions (in the X direction).

When the pivot arm 46 is lowered so as to become lower than a given position, the position control projection leaf 46*b* moves downward between the light-emitting elements Sa and Sb, thereby turning on the pivot arm attitude sensor S.

The pivot arm attitude sensor S is disposed so as to correspond to the respective paper feed trays 21 to 24.

In FIG. 4, a pivotal support member 51 is provided below the feed roller 43 so as to pivot on an unrotatively supported pivot shaft 47. The pivotal support member 51 supports a retard roller shaft 44*a* so as to rotate together with the retard roller 44.

In FIG. 4, a tension spring 52 provides the pivotal support member 51 with a rotating force around the pivot shaft 47. As a result of operation of the tension spring 52, the retard roller 44 is pressed against the feed roller 43.

A torque limiter 53 is fitted to the unrotatively-supported pivot shaft 47. In FIG. 4, the torque limiter 53 is provided with an output hub 53*a* fitted to the pivot shaft 47 and an input hub 53*b* which is disposed near to the output hub 53*a* so as to be able to rotate while receiving frictional resistance. A gear 54 is fixed to the input hub 53*b* of the torque limiter 53. The input hub 53*b* and the gear 54 rotate in conjunction with the retard roller shaft 44*a*.

The retard roller 44 pressed against the feed roller 43 that is rotatively driven, rotates in conjunction with the feed roller 43. The input hub 53*b* that rotates together with the shaft 44*a* of the retard roller 44, rotates while receiving frictional resistance in the vicinity of the fixedly fitted output hub 53*a*. At this time, since a braking force acts on the input hub 53*b*, it also acts on the retard roller 44. Therefore, in a state in which the sheet is not conveyed through the nipping area between the feed roller 43 and the retard roller 44, the retard roller 44 rotates in conjunction with the feed roller 43 and receives frictional resistance from the torque limiter 53. If the sheet taken out of one of the paper feed trays 21 to 24 is conveyed to the nipping area between the feed roller 43 and the retard roller 44 by the pickup roller 42, the sheet is conveyed by the feed roller 43. At this time, the surface of the sheet in contact with the retard roller 44 scrapes contaminants away from the surface of the retard roller 44. The thus-scraped contaminants become attached to the surface of the sheet that is in contact with the retard roller 44.

According to the studies conducted by the inventors of the present invention, the contaminants that become attached to the sheet after having been scraped away from the surface of the retard roller 44, are provided with characteristics according to the rubber material forming the retard roller 44. Depending on the characteristics of the contaminants, an image formed on the sheet becomes susceptible to imperfections. Although selection of the material of the retard roller 44 is very important in the embodiments of the present invention, the material will be described later.

In FIG. 3, the sheet stored in the paper feed trays 21 to 24 is sent to the sheet travel path 27. The thus sent sheet is conveyed to the transfer area Q3 by the sheet conveyor rollers 28.

The sheet supplied from the manual paper feed tray 26 10 is also sent to the sheet travel path 27 by a sheet delivery roller 56. The thus manually supplied sheet is also conveyed to the transfer area Q3 by the sheet conveyor rollers 28.

The transfer roller 57 to which a bias voltage is applied is disposed in the transfer area Q3. The transfer L5 roller 57 is pressed against the image carrier 13 in the transfer area Q3, and the toner image formed on the image carrier 13 is transferred to the sheet which passes through the transfer area Q3 by pressure and the bias voltage.

Figure 14A:
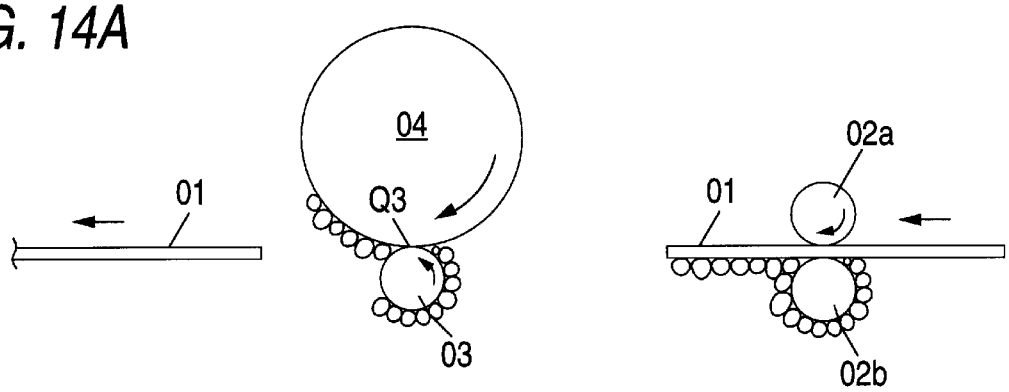
FIGS. 14A to 14C are schematic representations illustrating the mechanism of occurrence of imperfections in an image (or the occurrence of toner fog).
Figure 14B:
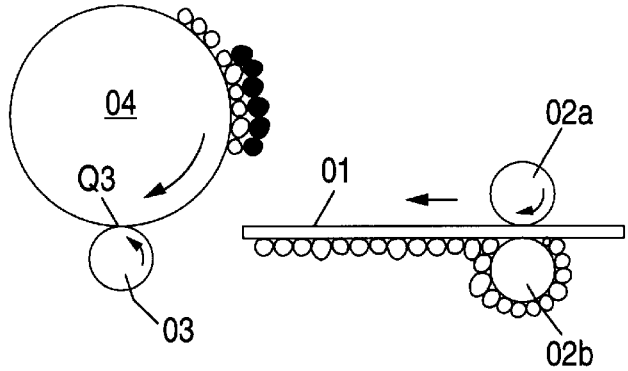
Figure 14C:
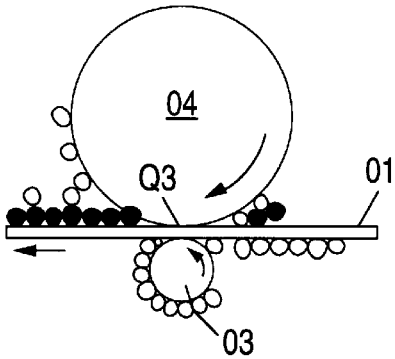

When the sheet passes through the transfer area Q3, the 0 contaminants scraped away from the retard roller 44 (see FIG. 3) become attached to the surface of the sheet which will come into contact with the transfer roller 57. The contaminants are scraped away from the surface of the sheet and then become attached to the transfer roller 57. After the sheet has passed through the transfer area Q3, the transfer roller 57 comes into direct contact with the image carrier 13. At this time, the contaminants attached to the transfer roller 57 move and become attached to the image carrier 13. As has been described with reference to FIGS. 14A, 14B, and 14C, when the contaminants attached to the transfer roller 57 pass through the development area Q2, toner becomes attached to the contaminants attached to the surface of the image carrier 13. As has been described with reference to FIG. 14C, if the toner is transferred to the next sheet that passes through the transfer area Q3, there arise imperfections (background fog) in the image formed on the sheet. Consequently, transfer of the contaminants attached to the transfer roller 57 to the image carrier 13 is undesirable.

According to the studies performed by the inventors, the amount of transfer of the contaminants from the transfer roller 57 to the image carrier 13 changes according to the characteristics of the rubber material of the surface of the transfer roller 57. Although selection of the material of the surface of the transfer roller 57 is very important in the embodiments of the present invention, the material will be described later.

After the toner image has been transferred from the surface of the image carrier 13 to the sheet in the transfer area Q3, residual toner is recovered from the surface of the image carrier 13 by a cleaner 58. Electric charge is removed from the image carrier 13 by an electric charge remover 59, and the image carrier 13 then becomes charged by the electrostatic charger 14.

The sheet to which the toner image has been transferred in the transfer area Q3 is conveyed to a fixing area Q4 while the toner image is in an unfixed state. The toner image is fixed by a fixing unit 62 disposed in the fixing area Q4. The sheet having a fixing toner image formed thereon is then conveyed to paper discharge rollers 63. The sheet is discharged to the sheet discharge tray TR0 by the discharge rollers 63.

A reverse travel path 66 of a sheet reverse unit 64 is connected to the upstream side of the discharge rollers 63. In a double-sided copying operation, where a sheet having an image formed on one side thereof is inverted, and the thus inverted sheet is again conveyed to the transfer area Q3, the front portion of the sheet having an image formed on one surface thereof is discharged to the sheet discharge tray TR0 by the discharge rollers 63 while only the rear end of the sheet is nipped between the discharge rollers 63. The discharge rollers 63 are then reversely rotated to cause the sheet switch back. The sheet having an image formed on one surface thereof is inverted through the reverse travel path 66 of the sheet reverse unit 64, and the thus-inverted sheet is sent to the transfer area Q3 again.

The rubber material forming the retard roller 44 and the transfer roller 57 will be described.

In the first embodiment, a high-polarity rubber roller is used for both the transfer member and the paper feed member. More specifically, the transfer roller 57 of the image forming apparatus F which serves as the transfer member is formed from a roller. The roller is made up of a cylindrical urethane rubber having an SP of 10 and a stainless core metal press-fitted into the urethane rubber. The retard roller 44 serving as a support paper feed member, the feed roller 43 serving as a conveyance paper feed member, and the pickup roller 42 are each formed from a roller which comprises a cylindrical chlorinated polyethylene rubber (CM) having an SP of 9.2 and a stainless core metal press-fitted into the CM.

A urethane-molded item is manufactured in the following manner. More specifically, after a composition given below had been sufficiently stirred, the thus-stirred composition was cooled to a temperature of 4° C. 35 parts by weight of tolylenediisocyanate was added to the composition as a component of diisocyanate. A mixture including bubbles of nitrogen gas was obtained by stirring the composition while nitrogen gas was blown into the composition. The thus-obtained mixture was injected into a metal mold heated beforehand to a temperature of 120° C. The mixture was heated and set for an hour at the same temperature, so that a cylindrical urethane foam rubber was formed.

(#) Example of Compositions of Urethane Rubber for use as a Transfer Roller

Component of polyol:
polyester polyol;
70 parts by weight
polyether polyol;
20 parts by weight
chloromethylated denatured polyethylene glycol;
10 parts by weight
Lithium perchlorate:
0.5 parts by weight
Silicon foam stabilizer:
2 parts by weight
Water:
0.3 parts by weight The chlorinated polyethylene rubber (CM) was cylindrically formed by vulcanizing the following rubber compound.

(#) Example of composition of the CM compound for use as a Retard Roller chlorinated polyethylene rubber:
100 parts by weight
carbon black:
30 parts by weight
plasticizer (dioctyl adipate):
50 parts by weight
filler (magnesium oxide):
10 parts by weight
vulcanizer (sulfur):
0.5 parts by weight
vulcanizing accelerator (2-mercaptoimidazoline):
3 parts by weight (Operation of the First Embodiment)

In the image forming apparatus of the first embodiment having the aforementioned features, a toner image forming means (11 to 14 and 16) forms a toner image on the surface of the image carrier 13.

In the paper feed unit 41, the pickup roller 42 takes a sheet out of one of the paper feed trays 21 to 24 and conveys the thus drawn sheet to the nipping area between the feed roller 43 and the retard roller 44. The feed roller 43 comes into contact with one side (or an upper surface) of the sheet picked up by the pickup roller 42 and exerts a conveying force on the sheet. The retard roller 44 is pressed against the feed roller 43 while being in contact with the other side (or a lower surface) of the sheet. The retard roller 44 applies a frictional brake to the sheet that is conveyed by means of the conveying force of the feed roller 43. As a result of this, if a plurality of sheets are conveyed to the nipping area between the feed roller 43 and the retard roller 44 by the pickup roller 42, only the uppermost sheet passes through the nipping area.

The sheet conveyor unit (27 and 28) sequentially conveys the sheet that has passed through the nipping area to the transfer area Q3, the fixing area Q4, and the sheet discharge tray TR0.

The transfer roller 57 disposed in the transfer area Q3 formed along the surface of the image carrier 13 is pressed against the surface of the image carrier 13 thereby to transfer the toner image f rom the surface of the image carrier 13 to the surface of the image record sheet during the course of passage of the transfer area Q3. The fixing unit 62 fixes the toner image on the sheet during the course of passage of the fixing area Q4.

In a case where commonly-used ordinary paper or OHP paper is used as the sheet, the sheet has a high polarity as it has been previously described. movement of contaminants in the case of the use of such a most commonly used sheet will be described in detail with reference to FIGS. 5A to 5C. In each of the embodiments, the peripheral speed of the image carrier 13 and the travel speed of the sheet S are set to 170 mm/s, and the peripheral speed of the transfer roller 57 is set to 170×1.07 (181.9) mm/s.

Figure 5A:
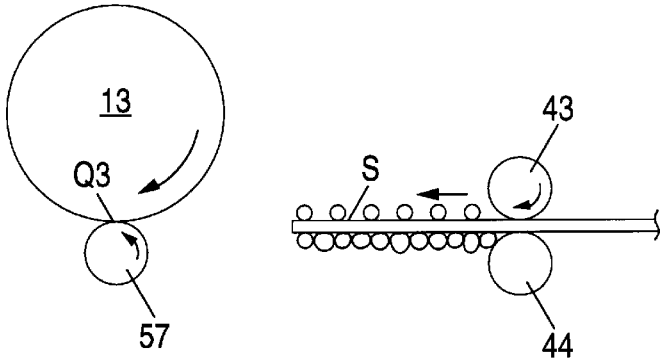
FIGS. 5A to 5C are schematic representations of contaminants transferred to a sheet S from a support paper feed member (or a retard roller) 44 in which a transfer roller 57 and the support paper feed roller (or the retard roller) 44 are made of a high-polarity rubber material.

In FIG. 5A, the image record sheets S taken out of one of the paper feed trays 21 to 24 by the pickup roller 42 are separated from each other one by one in a frictional manner by the feed roller 43 and the retard roller 44 which are in a pressed contact state. The sheet S is then conveyed to the transfer area Q3. At this time, contaminants (designated by a circle) are transferred to the sheet S from the feed roller 43 and the retard roller 44.

There is small slippage between the feed roller 43 and the sheet S, whereas there is large slippage between the retard roller 44 and the sheet S because the retard roller 44 applies a brake to the sheet S. For this reason, the amount of contaminants which are scraped away from the surface of the feed roller 43 and become attached to the sheet S is smaller than the amount of contaminants which are scraped away from the surface of the retard roller 44 and become attached to the sheet S. FIGS. 5A, 5B and 5C diagrammatically illustrate the amount of the contaminants transferred to the sheet S from the feed roller 43 and the retard roller 44 in an emphasized manner.

Both the retard roller 44 composed of the chlorinated polyethylene rubber (CM) and the transfer roller 57 composed of urethane rubber have a high polarity. Since the contaminants attached to the surface of the sheet that will come into contact with the transfer roller 57 are originated from the chlorinated polyethylene rubber (CM) forming the retard roller 44, they also have a high polarity. In contrast, the sheet S principally consisting of cellulose (an SP of 15.7) has a high polarity. As previously described, substances having an identical polarity usually possess compatibility with respect to each other, whereas substances whose polarities are different from each other do not have compatibility.

Figure 5B:
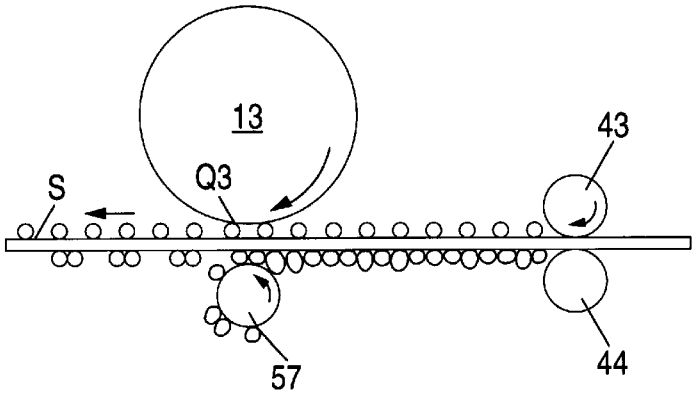

In FIG. 5B, the travel speed of the sheet S in the transfer area Q3 and the peripheral speed of the image carrier 13 are set to the same speed, and the peripheral speed of the transfer roller 57 is set to become faster than the travel speed of the sheet S by about 7%. Therefore, when the sheet S having the contaminants attached thereto is sent to the transfer area Q3, no slippage arises between the image carrier 13 and the sheet S. For this reason, the contaminants are prevented from moving to the surface of the image carrier 13. In contrast, since there is slippage between the transfer roller 57 and the sheet S, the contaminants are partially transferred from the sheet S to the transfer roller 57 when the transfer roller 57 comes into contact with the surface of the sheet that has come into contact with the retard roller 44.

The sheet S and the contaminants possess the same polarity, and hence they have strong compatibility with respect to each other. For these reasons, the contaminants are strongly adsorbed by the sheet S. Therefore, a trace amount of contaminants move to the transfer roller 57.

Figure 5C:
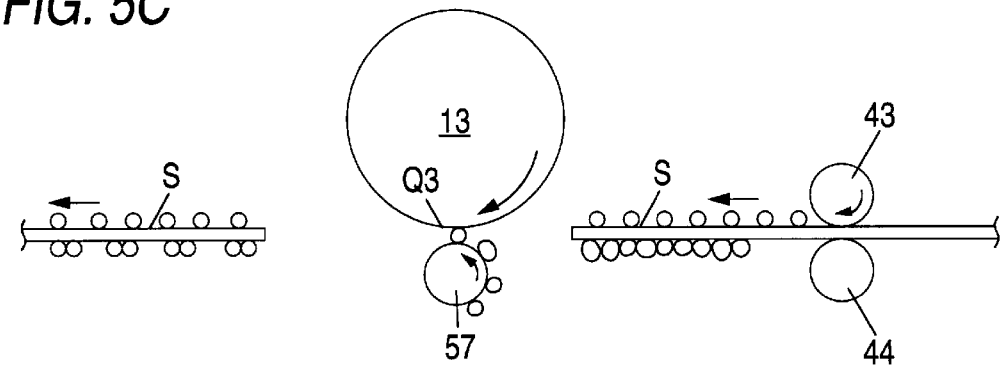

In FIG. 5C, during the time period over which the sheet S passes the transfer roller 57, and the next sheet S arrives at the transfer roller 57, the transfer roller 57 comes into direct contact with the image carrier 13. At this time, since the contaminants attached to the transfer roller 57 have the same polarity as that of urethane rubber which is the constituent material of the transfer roller 57, they are firmly attached to the transfer roller 57. Consequently, the contaminants will not move to the image carrier 13. Even if the image forming apparatus operates over a long period of time, contaminants will not cause imperfections in an image.

(Second Embodiment)

In a second embodiment, low-polarity rubber rollers are used for the transfer member and the paper feed member. More specifically, the transfer roller 57 serving as the transfer member of the image forming apparatus F is made up of a roller which comprises a cylindrical EPDM having an SP of 7.8 and a stainless metal core press-fitted into the EPDM. The retard roller 44 serving as a support paper feed member, the feed roller 43 serving as a conveyance paper feed member, and the pickup roller 42 are each formed from a roller which comprises a cylindrical EPDM and a stainless metal core press-fitted into the EPDM.

Each EPDM roller was cylindrically formed by vulcanizing each of the rubber compounds provided below.

(#) Example of composition of an expandable EPDM compound for use as a Transfer Roller EPDM:
100 parts by weight
Carbon black for conduction purposes:
23 parts by weight
Carbon black for reinforcing purposes:
20 parts by weight
Paraffinic oil:
45 parts by weight
Foaming agent:
10 parts by weight
Zinc oxide:
10 parts by weight
Zinc stearate:
2 parts by weight
Vulcanizing accelerator:
3 parts by weight (#) Example of composition of an EPDM compound for use as a Retard Roller EPDM:
100 parts by weight
Carbon black:
10 parts by weight
Paraffinic oil:
30 parts by weight
Filler:
Zinc oxide;
5 parts by weight
Zinc stearate;
1 part by weight
Silica;
20 parts by weight
Sulfur:
1 part by weight
Vulcanizing accelerator:
0.5 parts by weight (Operation of the Second Embodiment)

Figure 6A:
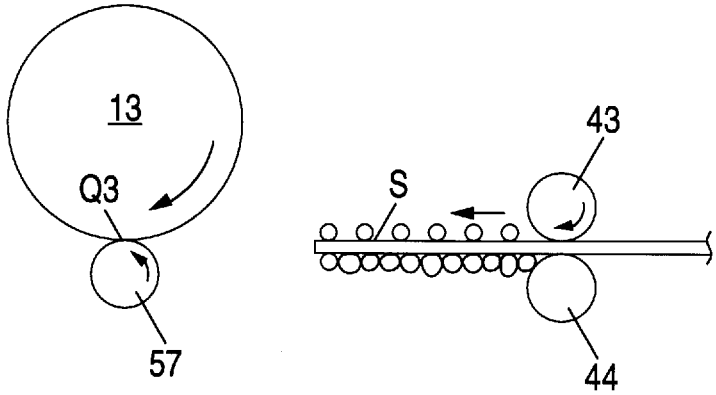
FIGS. 6A to 6C are schematic representations of contaminants transferred to a sheet S from the support paper feed member (or the retard roller) 44 in which the transfer roller 57 and the support paper feed roller (or the retard roller) 44 are made of a low-polarity rubber material.
Figure 6B:
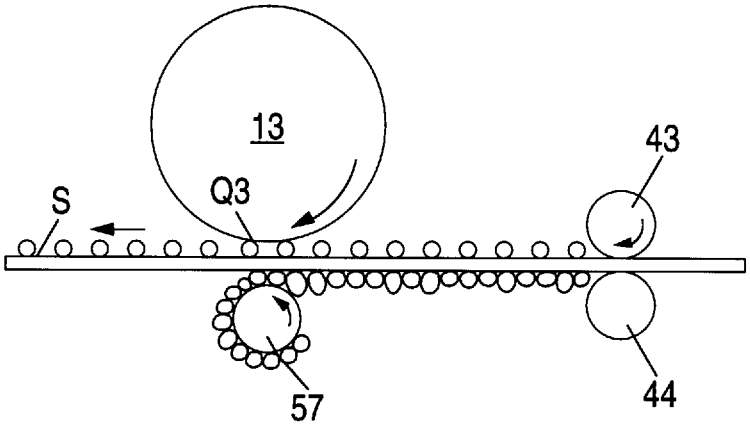

Overlapping explanations between the first embodiment and the second embodiment will be omitted here, and the movement of the contaminants will be described with reference to FIGS. 6A to 6C. As illustrated in FIG. 6A, in the image forming apparatus of the second embodiment having the previously described features, the amount of contaminants which are scraped away from the surface of the retard roller 44 and become attached to the sheet S is larger than the amount of contaminants which are scraped away from the surface of the feed roller 43 and become attached to the sheet S, as in the case of the first embodiment. Both the retard roller 44 and the transfer roller 57 composed of the EPDM have a low polarity. Since the contaminants attached to the surface of the sheet that will come into contact with the transfer roller 57 are originated from the EPDM forming the retard roller 44, they also have a low polarity. In contrast, the sheet S has a high polarity. As previously described, substances having an identical polarity usually possess compatibility with respect to each other.

The travel speed of the sheet S in the transfer area Q3 and the peripheral speeds of the image carrier 13 and the transfer roller 57 are set in the way as previously described. Therefore, no slippage arises between the image carrier 13 and the sheet S, whereas there is slippage between the transfer roller 57 and the sheet S.

Consequently, when the sheet S having the contaminants attached thereto is sent to the transfer area Q3, the contaminants are prevented from moving to the surface of the image carrier 13. In contrast, the sheet S and the contaminants are different in polarity from each other and do not have compatibility with respect to each other. Hence, when the transfer roller 57 comes into contact with the surface of the sheet that has come into contact with the retard roller 44, the contaminants are transferred to the transfer roller 57 from the sheet S. The contaminants thus transferred to the transfer roller 57 and the EPDM that is a constituent material of the transfer roller 57 have a low polarity, and hence the contaminants are firmly adsorbed by the transfer roller 57.

Figure 6C:
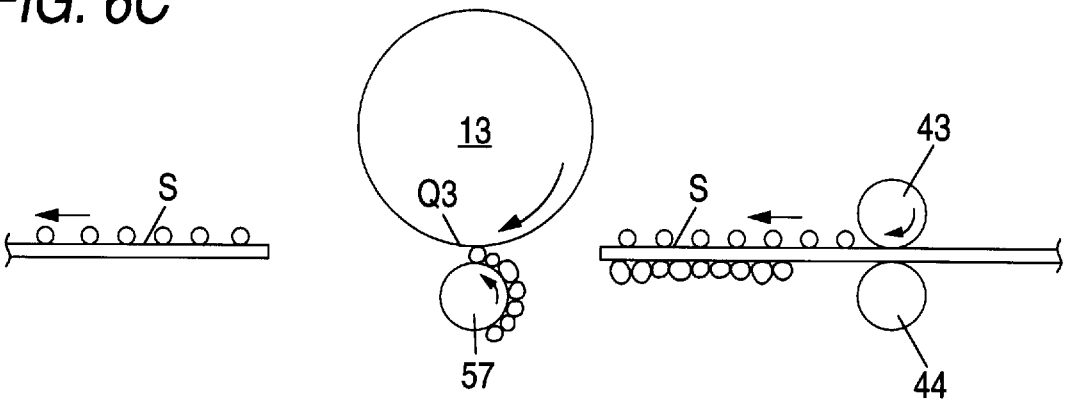

In FIG. 6C, during the time period over which the sheet S passes the transfer roller 57, and the next sheet S arrives at the transfer roller 57, the transfer roller 57 comes into direct contact with the image carrier 13. At this time, since the contaminants are firmly adsorbed by the transfer roller 57, the contaminants will not move to the image carrier 13. Even if the image forming apparatus operates over a long period of time, contaminants will not cause imperfections in an image.

(Third Embodiment)

In a third embodiment, a low-polarity rubber roller is used for the transfer member, and a high-polarity rubber roller is used for the paper feed member. More specifically, the transfer roller 57 serving as the transfer member of the image forming apparatus F is made up of a roller which comprises a cylindrical EPDM having an SP of 7.8 and a stainless metal core press-fitted into the EPDM. The retard roller 44 serving as a support paper feed member, the feed roller 43 serving as a conveyance paper feed member, and the pickup roller 41 are each formed from a roller which comprises a cylindrical CM having an SP of 9.2 and a stainless metal core press-fitted into the EPDM.

(Operation of the Third Embodiment)

Figure 7A:
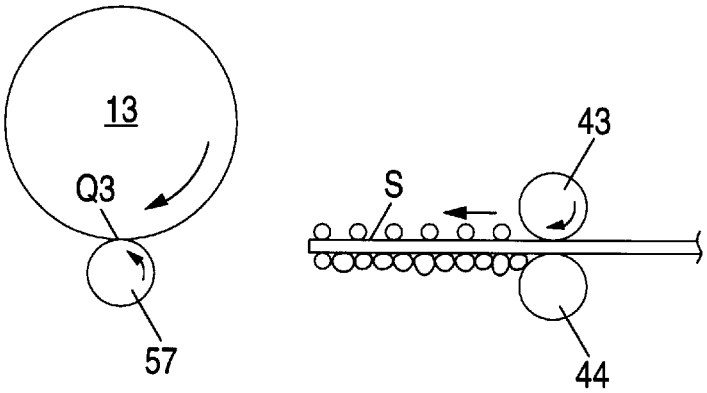
FIGS. 7A to 7C are schematic representations of contaminants transferred to a sheet S from the support paper feed member (or the retard roller) 44 in which the transfer roller 57 is made of a low-polarity rubber material, and the support paper feed roller (or the retard roller) 44 is made of a low-polarity rubber material.

Overlapping explanations between the first embodiment and the third embodiment will be omitted here, and the movement of the contaminants will be described with reference to FIGS. 7A to 7C. As illustrated in FIG. 7A, in the image forming apparatus of the third embodiment having the previously described features, the amount of contaminants which are scraped away from the surface of the retard roller 44 and become attached to the sheet S is larger than the amount of contaminants which are scraped away from the surface of the feed roller 43 and become attached to the sheet S, as in the case of the first embodiment. The transfer roller 57 composed of the EPDM have a low polarity, and the retard roller 44 composed of the CM has a high polarity. The contaminants attached to the surface of the sheet that will come into contact with the transfer roller 57 have also a high polarity.

Figure 7B:
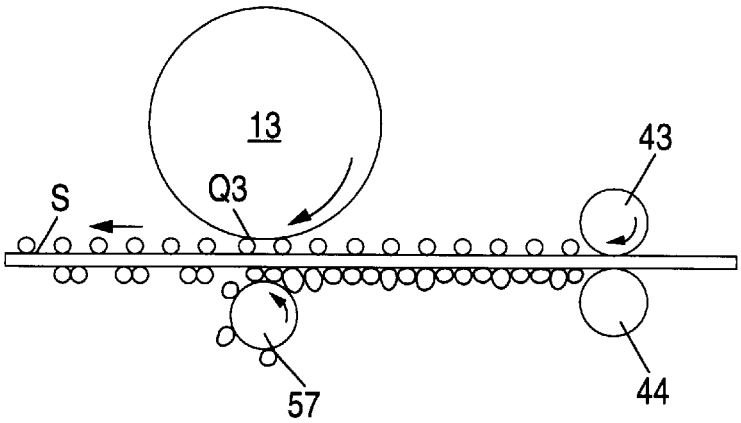

In FIG. 7B, when the sheet S having the contaminants attached thereto is sent to the transfer area Q3, no slippage arises between the image carrier 13 and the sheet S. Hence, the contaminants are prevented from moving to the surface of the image carrier 13. In contrast, since there is slippage between the transfer roller 57 and the sheet S, the contaminants are partially transferred to the transfer roller 57 from the sheet S when the transfer roller 57 comes into contact with the surface of the sheet that has come into contact with the retard roller 44.

The sheet S and the contaminants have the same polarity and compatibility with respect to each other, and hence the contaminants are firmly adsorbed by the sheet S. Therefore, a trace amount of the contaminants move to the transfer roller 57. Further, the contaminants attached to the surface of the sheet which has come into contact with the feed roller 43 are also firmly adsorbed by the sheet S.

Figure 7C:
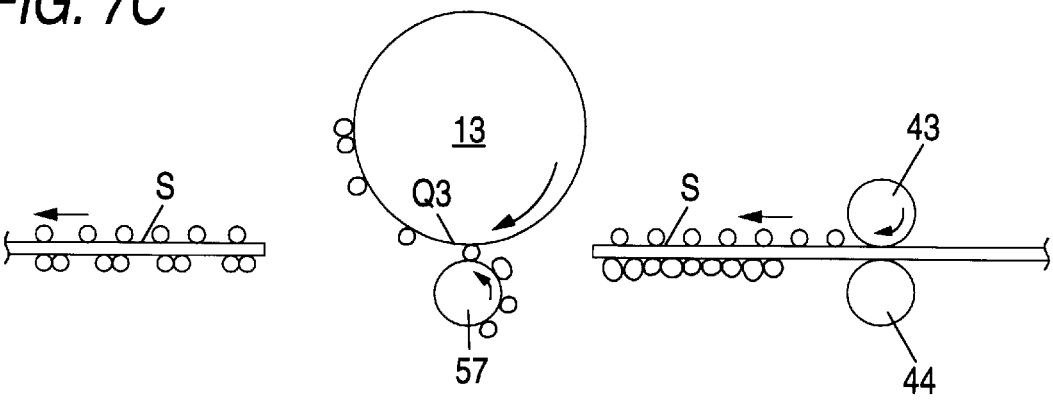

In FIG. 7C, during the time period over which the sheet S passes the transfer roller 57, and the next sheet S arrives at the transfer roller 57, the transfer roller 57 comes into direct contact with the image carrier 13. At this time, since the contaminants attached to the transfer roller 57 are different in polarity from the EPDM which is a constituent material of the transfer roller 57, they move to the image carrier 13 from the transfer roller 57. However, as previously described, the amount of the contaminants attached to the transfer roller 57 is very small, and hence even if the image forming apparatus operates over a long period of time, contaminants will not cause imperfections in an image.

Table 1 provides a summary of the relationship between the presence/absence of imperfections in an image and the combination of the constituent rubber materials of the retard roller 44 of the paper feed rollers (i.e., the pickup roller 41, the feed roller 43, and the retard roller 44) and the transfer roller 57.

In Table 1,

The first embodiment corresponds to i) Combination of a low-polarity transfer roller and a low-polarity paper feed roller;

the second embodiment corresponds to ii) Combination of a low-polarity transfer roller and a high-polarity paper feed roller; and the third embodiment corresponds to iii) Combination of a high-polarity transfer roller and a high-polarity paper feed roller.

TABLE 1

| | | Paper Feed Roller | |
|---|---|---|---|
| | | Lower polarity | High polarity |
| Transfer roller | Lower polarity | No picture quality deficiencies | No picture quality deficiencies Contaminates are absorbed by paper. |
| | High polarity | Picture quality deficiencies developed. | No picture quality deficiencies Contaminates are absorbed by paper. Contaminates are absorbed by a transfer roller. |

Although the respective embodiments have been described with reference to the example in which the surface of the sheet which will come into contact with the transfer roller 57 comes LO into contact with the retard roller 44, the surface of the sheet that will come into contact with the transfer roller 57 may be brought into contact with the pickup roller 42 and the feed roller 43. In this case, the polarity of the constituent rubber material of the pickup roller 42 and the feed roller 43 corresponds to the polarity of the retard roller 44 of each of the embodiments.

(Picture Quality Evaluation Test)

Table 2 provides the result of evaluation of the relationship between a picture quality and the combination of the transfer roller (BTR) made of urethane rubber and the material of the retard roller, the SPs of rubber materials, and the dielectric constants of the materials measured by application of a.c. of 50 Hz to the materials. In the evaluation of picture quality provided in Table 2, O designates a superior picture quality without occurrence of toner fog in a recorded image, and X designates picture quality deficiencies resulting from occurrence of fog in a recorded image.

As the retard roller, there are used rollers composed of various types of cylindrical rubber materials and a stainless metal core press-fitted into the rubber materials. As illustrated in the column "Number of types of products used in the test," each of the rubber materials was purchased from a different manufacturer. Further, a plurality of types of products having different names were purchased from the same manufacturer, and the tests were carried out using these products. For instance, four types of silicon products were purchased and tested, and ten types of cylindrical EPDM products were purchased and tested.

TABLE 2

Relationship between a picture quality and the combination of material of a surface layer of the transfer roller and the retard roller

| Material of retard roller | Number of types of products used in the test | SP | Dielectric constant (Hz) | Evaluations of picture quality obtained in a case where U having SP of 10 is used for BTR | Evaluations of picture quality obtained in a case where EPDM having SP of 7.8 is used for BTR |
|---|---|---|---|---|---|
| Si | 4 | 7.3–7.6 | 3–4 | X | O |
| EPDM | 10 | 7.8–7.9 | 2.5–3.5 | X | O |
| NR | 2 | 8.1 | 3–4 | X | O |
| PNR | 4 | 8.1 | 4 | O | O |
| NBR | 4 | 8.7–10.4 | 5–12 | O | O |
| CR | 3 | 8.7–9.3 | 5–8 | O | O |
| CSM | 1 | 8.9 | 5–8 | O | O |
| CM | 1 | 9.2–9.3 | 5.5–7.5 | O | O |
| U | 2 | 10 | 9–10 | O | O |

As is evident from Table 2, in the case of the transfer roller made of a high-polarity urethane rubber, a high-quality picture is obtained so long as the retard roller is made of high-polarity NBR, CR, CSM, CM, or U. Further, in the case of the transfer roller made of a low-polarity EPDM, it is seen that a high-quality image is obtained so long as the retard roller is made of any one of low-polarity Si, EPDM, NR, PNR, and the high-polarity rubber material.

The dielectric constant of the high-polarity rubber material measured by application of a.c. of 50 Hz to the rubber material, is greater than or equal to 4.5. The chemical structure of the rubber materials has atoms of nitrogen and oxygen attached to the principal polymer chain like, e.g., U, or the principal polymer chain off from which neither methyl group nor phenyl group is branched.

Figure 9:
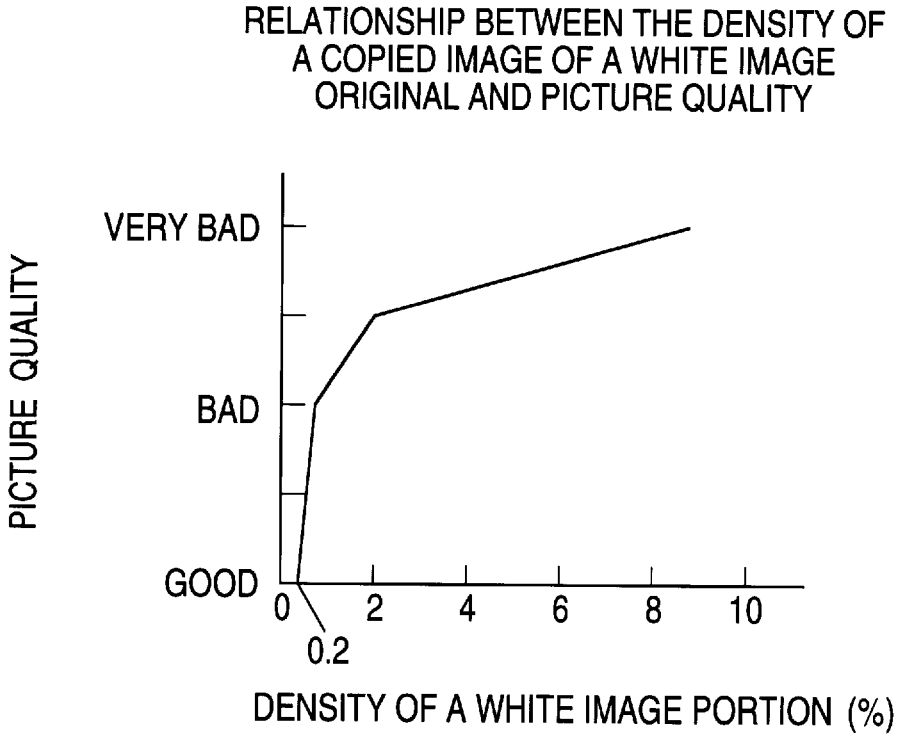
FIG. 9 is a graph illustrating the relationship between the density of a copied picture of a white image original and visually evaluated picture quality.
Figure 10:
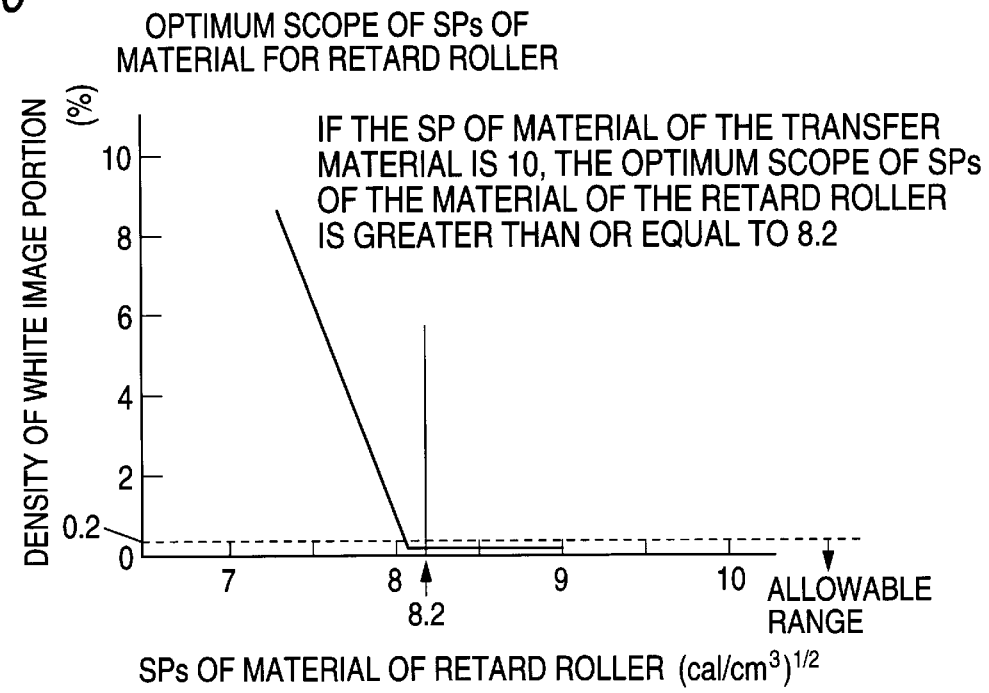
FIG. 10 is a graph illustrating the scope of SPs of appropriate retard roller materials.
Figure 11:
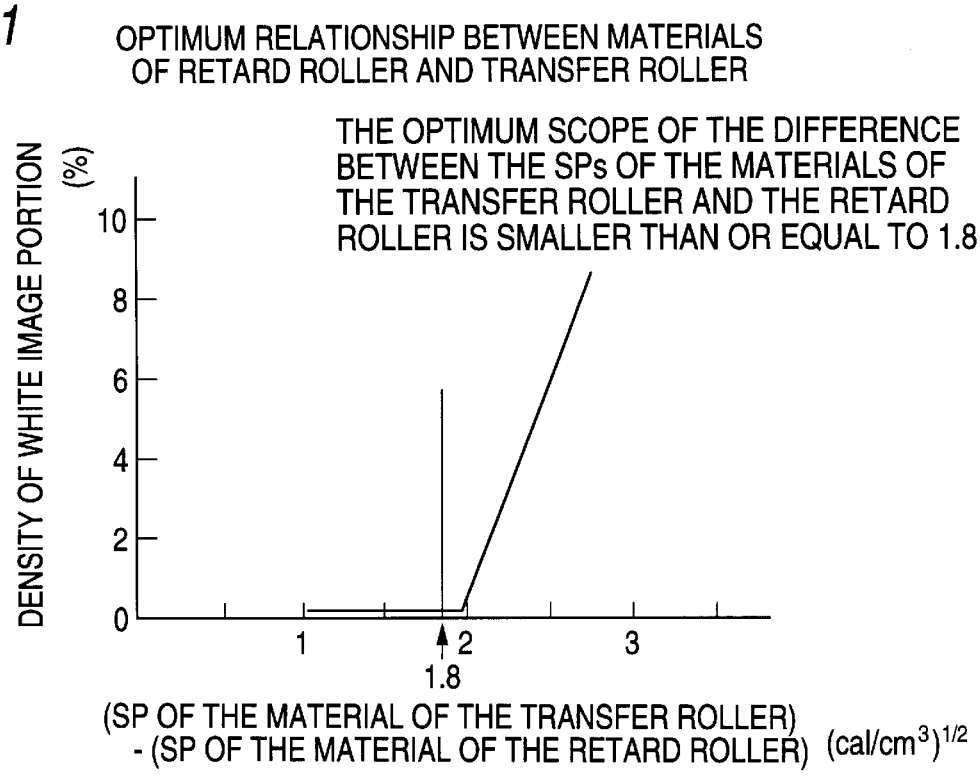
FIG. 11 is a graph illustrating the appropriate relationship between SPs of the materials of the transfer roller and the retard roller.
Figure 12:
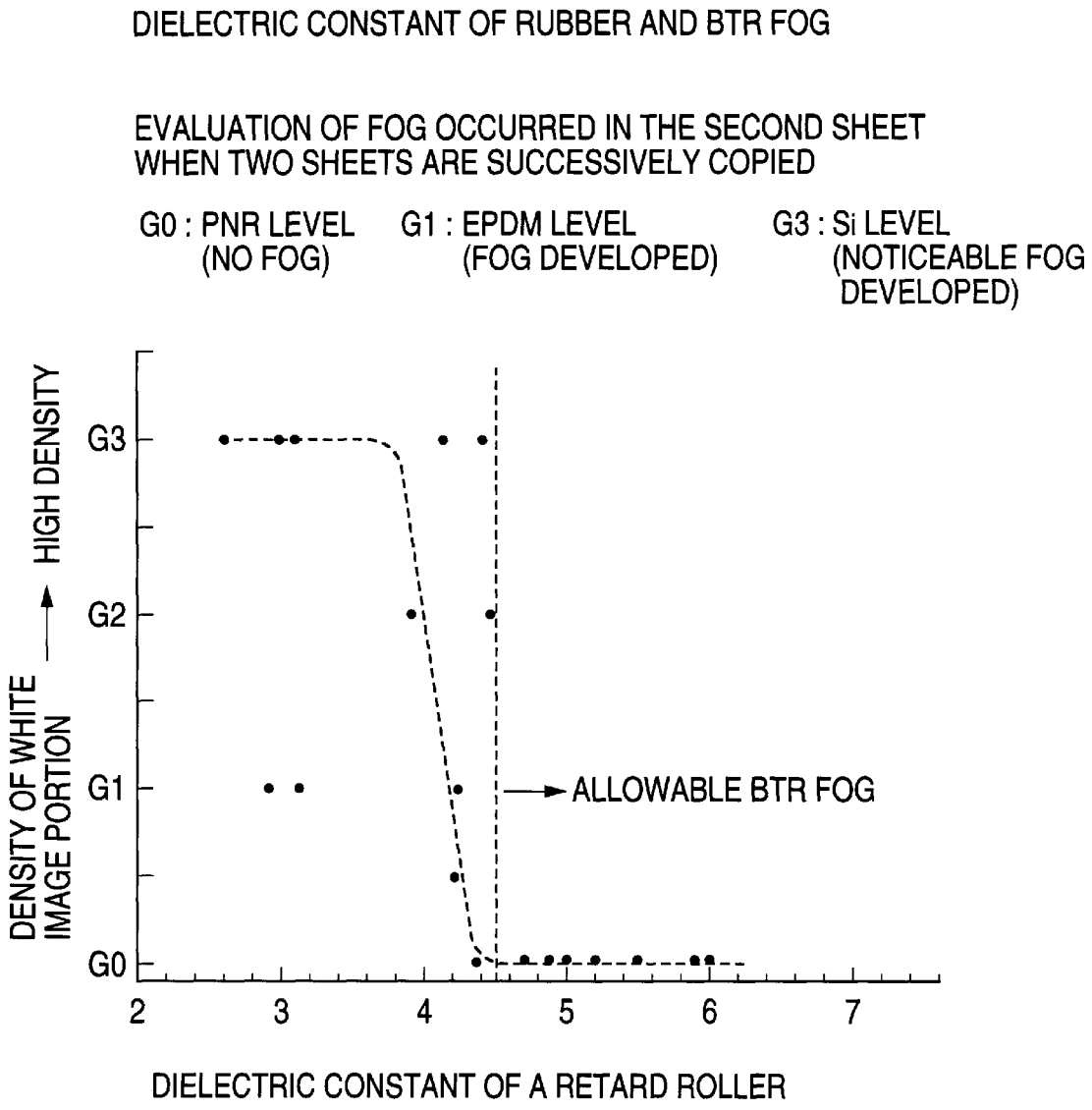
FIG. 12 is a graph illustrating the optimum scope of dielectric constants measured by application of a.c. of 50 Hz to the material of the surface of the retard roller.
Figure 13A:
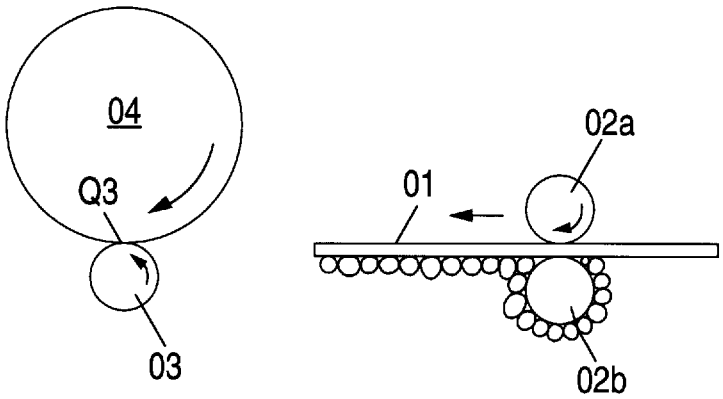
FIGS. 13A and 13B are schematic representations illustrating the mechanism of occurrence of imperfections in an image (or occurrence of toner fog)
Figure 13B:
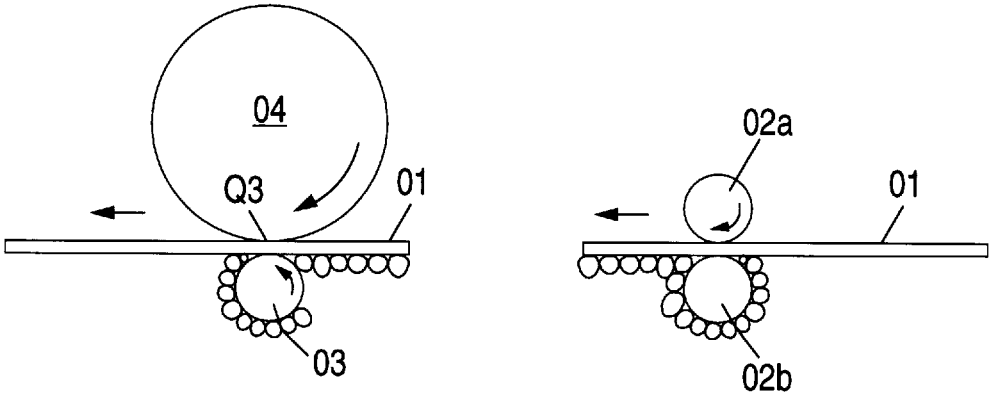

Next, FIGS. 9 to 12 illustrate a part of data obtained during the course of the picture quality evaluation test. FIG. 9 is a graph illustrating the relationship between the density of a copied image of a monochrome original and a visually evaluated picture quality. FIG. 10 is a graph illustrating the range of SPs of appropriate materials of the retard roller. FIG. 11 is a graph illustrating the appropriate relationship between SPs of materials for the transfer roller and materials for the retard roller. FIG. 12 is a graph illustrating the optimum range of dielectric constants measured by application of a.c. of 50 Hz to the material of the surface of the retard roller.

In FIG. 9, the horizontal axis represents the density of a recorded image of a white original in percentage, and the vertical axis represents the level of visual picture quality. In FIG. 9, as a result of visual evaluation of picture quality of the toner attached to the area which would have become a white image, the toner attached to the contaminants provided on the image carrier is fixed in the form of a recorded image if the density exceeds 0.2%, thereby deteriorating the picture quality of the image.

FIG. 10 is a graph related to the case of use of the transfer roller made of a urethane rubber having an SP of 10. In this graph, the horizontal axis represents an SP of the material forming the surface of the retard roller, and the vertical axis represents the density of a white image area of the recorded image in percentage. In FIG. 10, if the SP of the material of the retard roller becomes smaller than 8.2, the density of the white picture area of the record image becomes high. This means that the toner becomes attached to the area which would have become a white image as a result of occurrence of fog.

As illustrated in FIG. 9, if the density of the white picture area of the recorded image is 0.2% or less, a superior image is obtained. Therefore, it is only necessary that the SP of the constituent material of the retard rollers be set to 8.1 or more or, more particularly, 8.2 or more.

FIG. 11 is a graph related to the case of the transfer roller whose surface is made of urethane rubber having an SP of 10. In the graph, the horizontal axis represents the difference obtained by subtracting the (SP of the constituent material of the surface of the retard roller) from the (SP of the constituent material of the surface of the transfer roller); namely, the difference between the SPs of the rubber materials of the transfer roller and the retard roller. The vertical axis of the graph represents the density of a white image portion of the recorded image in percentage. In FIG. 11, if the difference of the SPs of the rubber materials of the transfer roller and the retard roller becomes greater than 1.8, the density of the white image portion of the recorded image is increased. This means the occurrence of fog as a result of transfer of toner to the area which would have become a white image.

Therefore, to obtain a superior picture quality in which the density of the white image portion of the recorded image is 0.2% or less, the rubber materials of the surfaces of the transfer roller and the retard roller should preferably have the same high polarity.

FIG. 12 illustrates data (designated by ● regarding the evaluation of fog arising in the second sheet after two sheets have been successively copied by use of the transfer roller made of a urethane rubber having an SP of 10. To obtain the data, rubber materials which are different in dielectric constant from each other, are manufactured by mixing various types of rubber materials such as PNR, EPDM, and Si. The retard rollers are manufactured using the thus manufactured rubber materials having different dielectric constants. In the graph illustrated in FIG. 12, the horizontal axis represents the dielectric constants of the rubber materials which are used for the retard roller and are different from each other with respect to dielectric constants measured by application of a.c. of 50 Hz to the rubber materials. The vertical axis of the graph represents the level of density obtained by visual evaluation of the toner fog occurred in the white portion of the second recorded image after successive copying of the two sheets; or the density of the image. The scales G0 to G3 provided along the vertical axis in FIG. 12 provide the following meanings.

G0: PNR level (the level of an image obtained in a case where PNR (see Table 2) is used as the material of the retard roller; i.e., the level of the image in which toner fog is not found by visual check. More specifically, the level in which the image is judged as being superior by visual check. In this level, the density is 0.2% or less).

G1: EPDM level (the level of an image obtained in a case where the EPDM (see Table 2) is used for the material of the retard roller; or the level in which the occurrence of the toner fog is found by visual check); and G3: Si level (the level of an image obtained in a case where the Si rubber (see Table 2) is used for the material of the retard roller; or the level in which the occurrence of the toner fog is noticeable by visual check)

According to the previously described visual evaluations of the recorded images, provided that the density of the white portion of the recorded image smaller than or equal to 0.2% is an allowable range, the range of dielectric constant of the material of the surface of the retard roller to obtain a superior picture quality measured by application of an a.c. of 50 Hz to the material, becomes greater than or equal to 4.5. (Reference Example 1)

Table 3 provides the result of a picture quality evaluation test carried out based under the same conditions as those under which the previous embodiments are implemented; namely, on condition that various types of rubber materials are used as the constituent material of the retard roller 44, the travel speed of the sheet S in the transfer area Q3 is set to be equal to the peripheral speed of the image carrier 13, and the peripheral speed of the transfer roller 57 made of urethane rubber is set to be faster than the travel speed of the sheet S by 7%.

Further, Table 3 provides the result of the picture quality evaluation test carried out on condition that the transfer roller 57 is rotated in conjunction with the rotation of the image carrier 13. In Table 3, O designates occurrence of no image quality deficiencies, and X designates occurrence of image quality deficiencies.

TABLE 3

| Material of retard roller | Driving of a transfer roller (+7%) | Driven transfer roller |
|---|---|---|
| Si | X | O |
| EPDM | X | O |
| NR | X | O |
| PNR | O | O |
| CM | O | O |
| U | O | O |

Transfer roller: Urethane

In a case where the peripheral speed of the transfer roller 57 is set to be faster than the travel speed of the sheet, the retard roller 44 composed of the low-polarity rubber material causes picture quality deficiencies as it has been made evident with reference to the conventional image forming apparatus. In contrast, if the transfer roller 57 is rotated in conjunction with the rotation of the image carrier 13, neither the image carrier 13 nor the transfer roller 57 causes slippage with respect to the sheet S. The contaminants attached to the sheet S do not move to the image carrier 13 and the transfer roller 57, thereby preventing occurrence of picture quality deficiencies.

(Reference Example 2)

Figure 8A:
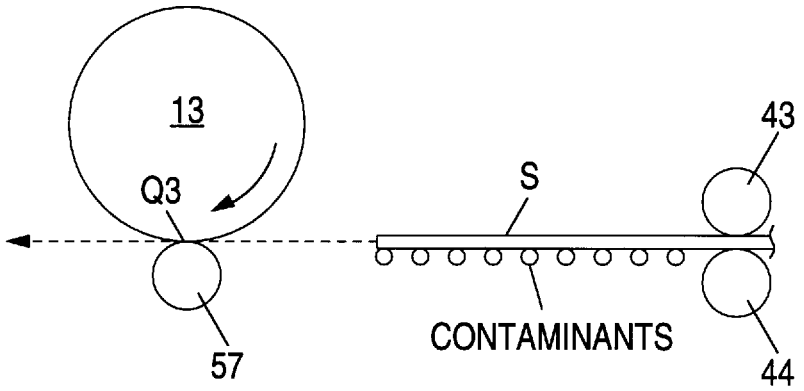
FIGS. 8A and 8B illustrate a case where the surface of the sheet having contaminants attached thereto comes into contact with the transfer roller and the image carrier.
Figure 8B:
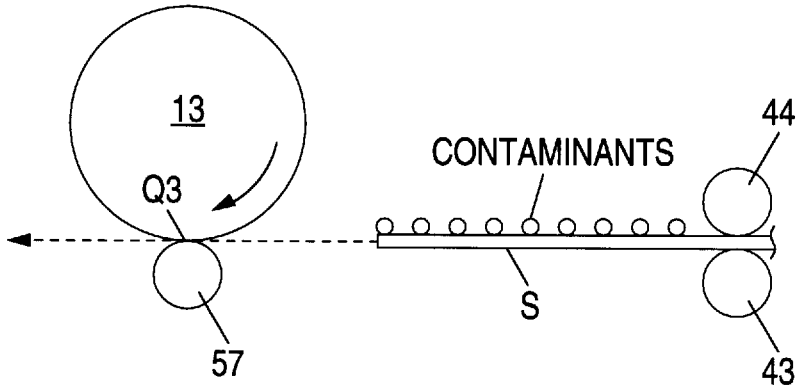

FIGS. 8A and 8B illustrate contaminants in which the surface of the sheet S having the contaminants attached thereto comes into contact with the transfer roller 57 and the image carrier 13 which are made of high-polarity urethane rubber. FIG. 8A illustrates a case where the surface of the sheet S having the contaminants attached thereto comes into contact with the transfer roller 57, and FIG. 8B illustrates a case where the surface of the sheet S having the contaminants attached thereto comes into contact with the image carrier 13.

In the example, various types of rubber materials are used as the constituent material of the retard roller 44. Further, the constituent rubber material of the transfer roller 57, the travel speed of the sheet S, and the peripheral speeds of the transfer roller 57 and the image carrier 13 are set to be equal to those used in the reference example 1 in which the transfer roller 57 does not rotate in conjunction with the rotation of the image carrier 13.

In FIGS. 8A and 8B, since the travel speed of the sheet S and the peripheral speed of the image carrier 13 are set to the same speed, no slippage arises between them. For this reason, even if the surface of the sheet S having a larger amount of contaminants attached thereto comes into contact with the image carrier 13, the contaminants are not transferred to the image carrier 13 from the sheet S, thereby preventing occurrence of picture quality deficiencies (or fog).

However, there is slippage between the transfer roller 57 and the sheet S, if the surface of the sheet S having a larger amount of contaminants attached thereto comes into contact with the transfer roller 57, the contaminants are transferred to the transfer roller 57. The transfer roller 57 is made of a high-polarity urethane rubber. If the contaminants originated from the rubber material of the retard roller 44 have a low polarity, there is no compatibility between the contaminants and the constituent rubber material of the transfer roller 57. Therefore, the contaminants move to the image carrier 13 during the time period over which the transfer roller 57 is in direct contact with the image carrier 13, thereby resulting in picture quality deficiencies.

Table 4 provides a summary of the result of the picture quality evaluation test.

TABLE 4

| Material of a retard roller | In a case where a contaminated surface of the sheet comes into contact with the transfer roller | In a case where a contaminated surface of the sheet comes into contact with the image carrier |
|---|---|---|
| Si | X | O |
| EPDM | X | O |
| NR | X | O |
| PNR | O | O |
| CM | O | O |
| U | O | O |

Transfer roller: Urethane

Although the embodiments of the present invention have been described in detail, the present invention is not limited to these embodiments. Various minor design changes of the present invention are conceivable within the scope of the gist of the present invention disclosed in the appended claims. (E01) It is possible to prevent occurrence of picture quality deficiencies (or toner fog) resulting from transfer of contaminants from the surface of a sheet to an image carrier through a transfer member.

What is claimed is:

1. An image forming apparatus comprising:

(A1) toner image forming means for forming a toner image on the surface of an image carrier;

(A2) a transfer member which is disposed in a transfer area along the surface of the image carrier and transfers the toner image from the surface of the image carrier to the surface of an image record sheet that passes the transfer area while it is pressed against the surface of the image carrier;

(A3) a paper feed unit having paper feed members which are brought into frictional contact with the sheets loaded in paper feed trays and carry one of the sheets toward the transfer member;

(A4) a sheet conveyor unit for conveying the sheet having passed through the paper feed unit to the transfer area; and (A5) the paper feed member which comes into contact with the surface of the sheet to be brought into contact with the transfer member and is formed from rubber material having a solubility parameter of greater than or equal to 8.2 $(cal/cm^3)^{1/2}$.

2. The image forming apparatus of claim 1, wherein (A6) the paper feed member of the paper feed unit is a pickup paper feed member which comes into frictional contact with the upper surface of the sheet loaded in the paper feed tray so as to take the sheet out of the paper feed tray.

3. The image forming apparatus of claim 1, wherein (A7) the paper feed member of the paper feed unit is a paper feed member for conveying purposes which comes into frictional contact with one surface of the sheet taken out of the paper feed tray so as to exert a conveying force on the sheet.

4. The image forming apparatus of claim 1, wherein (A8) the paper feed member of the paper feed unit is a paper feed member for supporting purposes which comes into frictional contact with one surface of the sheet taken out of the paper feed tray so as to apply a brake to the sheet.

5. The image forming apparatus of claim 1, wherein (A9) the transfer member is formed from a rubber material having a solubility parameter of greater than or equal to 7.8 $(cal/cm^3)^{1/2}$ and smaller than or equal to 10 $(cal/cm^3)^{1/2}$.

6. The image forming apparatus of claim 5, wherein (A10) the rubber material of the transfer member is a urethane rubber.

7. The image forming apparatus of claim 5, wherein (A11) the rubber material of the transfer member is EPDM.

8. The image forming apparatus of claim 5, wherein (B11) the rubber material of the transfer member is EPDM.

9. The image forming apparatus of claim 1, wherein (A12) the image carrier which is formed from a photosensitive element covered with polycarbonate.

10. An image forming apparatus comprising:

(B1) toner image forming means for forming a toner image on the surface of an image carrier:

(B2) a transfer member which is disposed in a transfer area along the surface of the image carrier and transfers the toner image from the surface of the image carrier to the surface of an image record sheet that passes the transfer area while it is pressed against the surface of the image carrier;

(B3) a paper feed unit having paper feed members which are brought into frictional contact with the sheets loaded in paper feed trays and carry one of the sheets toward the transfer member;

(B4) a sheet conveyor unit for conveying the sheet having passed through the paper feed unit to the transfer area; and (B5) the paper feed member which comes into contact with the surface of the sheet to be brought into contact with the transfer member and is formed from rubber material having a dielectric constant of greater than or equal to 4.5 measured by application of a.c. 50 Hz to the paper feed member.

11. The image forming apparatus of claim 10, wherein (B6) the paper feed member of the paper feed unit is a pickup paper feed member which comes into frictional contact with the upper surface of the sheet loaded in the paper feed tray so as to take the sheet out of the paper feed tray.

12. The image forming apparatus of claim 10, wherein (B7) the paper feed member of the paper feed unit is a paper feed member for conveying purposes which comes into frictional contact with one surface of the sheet taken out of the paper feed tray so as to exert a conveying force on the sheet.

13. The image forming apparatus of claim 10, wherein (B8) the paper feed member of the paper feed unit is a paper feed member for supporting purposes which comes into frictional contact with one surface of the sheet taken out of the paper feed tray so as to apply a brake to the sheet.

14. The image forming apparatus of claim 10, wherein (B9) the transfer member is formed from a rubber material having a solubility parameter of greater than or equal to 7.8 $(cal/cm^3)^{1/2}$ and smaller than or equal to 10 $(cal/cm^3)^{1/2}$.

15. The image forming apparatus of claim 14, wherein (B10) the rubber material of the transfer member is urethane rubber.

16. The image forming apparatus of claim 10, wherein (B12) the image carrier which is formed from a photosensitive element covered with polycarbonate.

17. An image forming apparatus comprising:

(C1) toner image forming means for forming a toner image on the surface of an image carrier:

(C2) a transfer member which is disposed in a transfer area along the surface of the image carrier and transfers the toner image from the surface of the image carrier to the surface of an image record sheet that passes the transfer area while it is pressed against the surface of the image carrier;

(C3) a paper feed unit having paper feed members which are brought into frictional contact with the sheets loaded in paper feed trays and carry one of the sheets toward the transfer member;

(C4) a sheet conveyor unit for conveying the sheet having passed through the paper feed unit to the transfer area; and (C5) the paper feed member which comes into contact with the surface of the sheet to be brought into contact with the transfer member and is formed from rubber material having a substituent other than hydrocarbon radicals attached to the principal polymer chain.

18. The image forming apparatus of claim 17, wherein (C6) the substituent is the rubber material having at least one atom selected from the group consisting of chlorine, nitrogen, and oxygen.

19. The image forming apparatus of claim 17, wherein (C7) the rubber material is made of one type of rubber selected from the group comprising an acrylonitrile-butadiene rubber,a chloroprene rubber, a chlorinated polyethylene rubber, a chlorosulfonated polyethylene rubber, and a urethane rubber, or is made of a blend rubber comprising two or more rubbers selected from the above group.

20. An image forming apparatus comprising:

(D1) toner image forming means for forming a toner image on the surface of an image carrier;

(D2) a transfer member which is disposed in a transfer area along the surface of the image carrier and transfers the toner image from the surface of the image carrier to the surface of an image record sheet that passes the transfer area while it is pressed against the surface of the image carrier;

(D3) a paper feed unit having paper feed members which are brought into frictional contact with the sheets loaded in paper feed trays and carry one of the sheets toward the transfer member;

(D4) a sheet conveyor unit for conveying the sheet having passed through the paper feed unit to the transfer area;

(D5) the transfer member formed from rubber material having a solubility parameter of smaller than 8.2 $(cal/cm^3)^{1/2}$; and the paper feed member which comes into contact with the surface of the sheet to be brought into contact with the transfer member and is formed from rubber material having a solubility parameter of smaller than 8.2 $(cal/cm^3)^{1/2}$.

* * * * *